US011339669B2

(12) United States Patent
Tsuji et al.

(10) Patent No.: US 11,339,669 B2
(45) Date of Patent: May 24, 2022

(54) TURBINE BLADE AND GAS TURBINE

(71) Applicant: Mitsubishi Hitachi Power Systems, Ltd., Yokohama (JP)

(72) Inventors: Yoshifumi Tsuji, Yokohama (JP); Ryuta Ito, Tokyo (JP); Hiroyuki Otomo, Yokohama (JP); Satoshi Hada, Yokohama (JP); Susumu Wakazono, Yokohama (JP)

(73) Assignee: MITSUBISHI POWER, LTD., Kanagawa (JP)

( * ) Notice: Subject to any disclaimer, the term of this patent is extended or adjusted under 35 U.S.C. 154(b) by 161 days.

(21) Appl. No.: 16/617,266

(22) PCT Filed: Jul. 4, 2018

(86) PCT No.: PCT/JP2018/025385
§ 371 (c)(1),
(2) Date: Nov. 26, 2019

(87) PCT Pub. No.: WO2019/009331
PCT Pub. Date: Jan. 10, 2019

(65) Prior Publication Data

US 2021/0123349 A1 Apr. 29, 2021

(30) Foreign Application Priority Data

Jul. 7, 2017 (JP) ..... JP2017-134101

(51) Int. Cl.
*F01D 5/18* (2006.01)

(52) U.S. Cl.
CPC ..... *F01D 5/187* (2013.01); *F05D 2240/122* (2013.01); *F05D 2240/304* (2013.01);
(Continued)

(58) Field of Classification Search
CPC ..... F05D 2250/185; F05D 2240/35; F05D 2240/307; F05D 2240/304; F05D 2240/122; F01D 5/187; F01D 5/186
See application file for complete search history.

(56) References Cited

U.S. PATENT DOCUMENTS 5,378,108 A 1/1995 Zelesky
5,498,126 A * 3/1996 Pighetti ..... F01D 9/065 415/115
(Continued)

FOREIGN PATENT DOCUMENTS

EP 0 392 664 10/1990
JP 56-159507 12/1981
(Continued)

OTHER PUBLICATIONS

Notification of Reason for Refusal dated Nov. 23, 2020 in corresponding Korean Patent Application No. 10-2019-7034910, with English Translation.
(Continued)

*Primary Examiner* — Courtney D Heinle
*Assistant Examiner* — Andrew Thanh Bui
(74) *Attorney, Agent, or Firm* — Wenderoth, Lind & Ponack, L.L.P.

(57) ABSTRACT

A turbine blade includes an airfoil portion, a cooling passage inside the airfoil portion, and a plurality of cooling holes formed in a trailing edge part of the airfoil portion. The cooling holes communicating with the cooling passage and opening in a surface of the trailing edge part. A relation of d_up<d_mid<d_down is satisfied, where d_mid is an index indicating opening densities of the cooling holes in a center region including an intermediate position between a first end and a second end of the airfoil portion in the blade height direction, d_up is an index in a region positioned upstream of a flow of a cooling medium in the cooling passage from
(Continued)

the center region in the blade height direction, and d_down is an index in a region positioned downstream of the flow of the cooling medium from the center region in the blade height direction.

19 Claims, 25 Drawing Sheets

(52) U.S. Cl.
CPC .... *F05D 2240/307* (2013.01); *F05D 2240/35* (2013.01); *F05D 2250/185* (2013.01)

(56) References Cited

U.S. PATENT DOCUMENTS

| | | | | |
|---|---|---|---|---|
| 7,387,492 | B2 * | 6/2008 | Pang | F01D 5/186 416/97 R |
| 8,807,943 | B1 | 8/2014 | Liang | |
| 9,447,692 | B1 | 9/2016 | Liang | |
| 9,638,046 | B2 * | 5/2017 | Papple | F01D 5/187 |
| 2004/0136824 | A1 | 7/2004 | Boyer | |
| 2004/0146402 | A1 | 7/2004 | Soechting et al. | |
| 2005/0276697 | A1 | 12/2005 | McGrath et al. | |
| 2007/0031252 | A1 | 2/2007 | Walters et al. | |
| 2008/0273988 | A1 | 11/2008 | Tibbott et al. | |
| 2009/0214328 | A1 | 8/2009 | Tibbott et al. | |

FOREIGN PATENT DOCUMENTS

| | | |
|---|---|---|
| JP | 49-051907 | 8/1987 |
| JP | 08-014001 | 1/1996 |
| JP | 9-511042 | 11/1997 |
| JP | 2004-137958 | 5/2004 |
| JP | 10-2004-0064649 | 7/2004 |
| JP | 2004-225690 | 8/2004 |
| JP | 2005-351277 | 12/2005 |

OTHER PUBLICATIONS

International Search Report dated Sep. 18, 2018 in International (PCT) Application No. PC/TJP2018/025385 with English translation.
International Preliminary Report on Patentability and Written Opinion of the International Searching Authority dated Jan. 16, 2020 with English translation.
Japanese Office Action dated Aug. 4, 2017 in corresponding Japanese Patent Application No. 2017-134101 with machine translation.
Japanese Office Action dated Dec. 8, 2017 in corresponding Japanese Patent Application No. 2017-134101 with machine translation.

* cited by examiner

TURBINE BLADE AND GAS TURBINE

TECHNICAL FIELD

The present disclosure relates to a turbine blade and a gas turbine.

BACKGROUND

It is known that in a turbine blade of a gas turbine or the like, a turbine blade exposed to a high-temperature gas flow or the like is cooled by flowing a cooling medium to a cooling passage formed inside the turbine blade.

For example, Patent Document 1 discloses a turbine rotor blade provided with an inner flow passage which is arranged in a combustion gas flow passage of a gas turbine and where a cooling medium internally flows. In a trailing edge part of the turbine rotor blade, a plurality of outlets are arranged in a direction connecting a blade root and a blade tip. The outlets are disposed so as to open to a trailing-edge end. The cooling medium which is supplied from a supply port disposed in a blade root portion of the turbine rotor blade to the inner flow passage is partially blown out of the plurality of outlets disposed in the trailing edge part while passing through the inner flow passage.

CITATION LIST

Patent Literature

Patent Document 1: JP2004-225690A

SUMMARY

Technical Problem

Meanwhile, according to the researches conducted by the present inventors, a temperature distribution and/or a pressure distribution can occur in a cooling passage formed inside a turbine blade. Thus, it is considered that the blade can be cooled more effectively by performing cooling corresponding to the temperature distribution and/or the pressure distribution in the cooling passage.

However, Patent Document 1 does not specifically discloses that the turbine blade is cooled in correspondence with the temperature distribution and/or the pressure distribution in the cooling passage.

In view of the above, an object of at least one embodiment of the present invention is to provide a turbine blade and a gas turbine capable of cooling the turbine blade effectively.

Solution to Problem (1) A turbine blade according to at least one embodiment of the present invention includes an airfoil portion, a cooling passage extending in a blade height direction inside the airfoil portion, and a plurality of cooling holes formed in a trailing edge part of the airfoil portion to be arranged in the blade height direction, the plurality of cooling holes communicating with the cooling passage and opening to a surface of the airfoil portion in the trailing edge part. A formation region of the plurality of cooling holes in the trailing edge part includes a center region including an intermediate position between a first end and a second end of the airfoil portion in the blade height direction, the center region having a constant index d_mid indicating opening densities of the plurality of cooling holes, an upstream region positioned upstream of a flow of a cooling medium in the cooling passage from the center region in the blade height direction, the upstream region having a constant index d_up indicating the opening densities of the plurality of cooling holes, and a downstream region positioned downstream of the flow of the cooling medium from the center region in the blade height direction, the downstream region having a constant index d_down indicating the opening densities of the plurality of cooling holes. A relation of d_up<d_mid<d_down is satisfied.

Since the cooling medium flows in the cooling passage formed inside the airfoil portion while cooling the airfoil portion, a temperature distribution may occur in which a temperature increases downstream of the flow of the cooling medium. In this regard, in the above configuration (1), since the opening densities of the cooling holes are higher at the position downstream than at the position upstream of the flow of the cooling medium in the cooling passage, it is possible to increase a supply flow rate of the cooling medium via the cooling holes downstream where the temperature of the cooling medium is relatively high. Thus, it is possible to appropriately cool the trailing edge part of the turbine blade in accordance with the temperature distribution of the cooling passage.

(2) A turbine blade according to at least one embodiment of the present includes an airfoil portion, a cooling passage extending in a blade height direction inside the airfoil portion, and a plurality of cooling holes formed in a trailing edge part of the airfoil portion to be arranged in the blade height direction and to perform convection-cooling of the trailing edge part, the plurality of cooling holes communicating with the cooling passage and penetrating the trailing edge part to open to a trailing-edge end surface. A relation of d_up<d_down<d_mid is satisfied, where d_mid is an index indicating opening densities of the cooling holes in a center region including an intermediate position between a first end and a second end of the airfoil portion in the blade height direction, d_up is an index in a region positioned upstream of a flow of a cooling medium in the cooling passage from the center region in the blade height direction, and d_down is an index in a region positioned downstream of the flow of the cooling medium from the center region in the blade height direction. A formation region of the plurality of cooling holes in the trailing edge part includes the center region including the intermediate position between the first end and the second end of the airfoil portion in the blade height direction, the center region having the constant index d_mid indicating the opening densities of the plurality of cooling holes, a most upstream region positioned upstream of the flow of the cooling medium in the cooling passage from the center region in the blade height direction, the most upstream region being disposed in a most upstream side of the formation region, the most upstream region having the constant index d_up indicating the opening densities of the plurality of cooling holes, and a most downstream region positioned downstream of the flow of the cooling medium from the center region in the blade height direction, the most downstream region being disposed in a most downstream side of the formation region, the most downstream region having the constant index d_down indicating the opening densities of the plurality of cooling holes.

The temperature of a gas flowing through a combustion gas flow passage where the turbine blade is arranged tends to be higher in the center region than in regions on the sides of both end parts (the first end and the second end) of the airfoil portion in the blade height direction. On the other hand, since the cooling medium flows in the cooling passage formed inside the airfoil portion while cooling the airfoil portion, the temperature distribution may occur in which the temperature increases downstream of the flow of the cooling medium. In this case, in order to appropriately cool the trailing edge part, it is desirable to maximize flow rate of the cooling medium via the cooling holes in the center region in the blade height direction and to make flow rate of the cooling medium via the cooling holes higher in the region positioned downstream than in the region positioned upstream of the flow of the cooling medium in the cooling passage.

In this regard, with the above configuration (2), since the opening densities of the cooling holes in the center region are higher than the opening densities of the cooling holes in the region positioned upstream (upstream region) and the region positioned downstream (downstream region) from the center region, it is possible to increase the supply flow rate of the cooling medium via the cooling holes in the center region where the temperature of the gas flowing through the combustion gas flow passage is relatively high. In addition, in the above configuration (2), since the opening densities of the cooling holes are higher in the above-described downstream region than in the above-described upstream region, it is possible to increase the supply flow rate of the cooling medium via the cooling holes in the downstream region having the higher cooling medium temperature than the upstream region. Thus, it is possible to appropriately cool the trailing edge part of the turbine blade in accordance with the temperature distribution of the cooling passage.

(3) A turbine blade according to at least one embodiment of the present includes an airfoil portion, a cooling passage extending in a blade height direction inside the airfoil portion, and a plurality of cooling holes formed in a trailing edge part of the airfoil portion to be arranged in the blade height direction, the plurality of cooling holes communicating with the cooling passage and opening to a surface of the airfoil portion in the trailing edge part. The turbine blade is a rotor blade. A relation of d_tip<d_mid<d_root is satisfied, where d_mid is an index indicating opening densities of the cooling holes in a center region including an intermediate position between a tip and a root of the airfoil portion in the blade height direction, d_tip is an index in a region positioned closer to the tip than the center region in the blade height direction, and d_root is an index in a region positioned closer to the root than the center region in the blade height direction. Each of the indexes d_tip, d_mid, and d_root indicating the opening densities is represented by a ratio D/P of a through-hole diameter D of each of the cooling holes disposed so as to penetrate the trailing edge part to a pitch P between the cooling holes adjacent to each other in the blade height direction. A formation region of the plurality of cooling holes in the trailing edge part includes the center region including the intermediate position between the tip and the root of the airfoil portion in the blade height direction, the center region having the constant index d_mid indicating the opening densities of the plurality of cooling holes, a tip region positioned closer to the tip than the center region in the blade height direction and closest to the tip in the formation region, the tip region having the constant index d_tip indicating the opening densities of the plurality of cooling holes, and a root region positioned closer to the root than the center region in the blade height direction and closest to the root in the formation region, the root region having the constant index d_root indicating the opening densities of the plurality of cooling holes.

Since a centrifugal force acts on the cooling medium in the cooling passage formed inside the airfoil portion of the rotor blade upon operation of a turbine, a pressure distribution may occur in which a pressure increases on the side of the tip of the airfoil portion in the cooling passage. In this regard, in the above configuration (3), since the opening densities of the cooling holes are lower at the position on the side of the tip than at the position on the side of the root of the airfoil portion, it is possible to decrease a variation in the supply flow rate of the cooling medium via the cooling holes in the blade height direction even if the above-described pressure distribution occurs. Thus, it is possible to appropriately cool the trailing edge part of the turbine blade in accordance with the pressure distribution of the cooling passage.

(4) A turbine blade according to at least one embodiment of the present invention includes an airfoil portion, a cooling passage extending in a blade height direction inside the airfoil portion, and a plurality of cooling holes formed in a trailing edge part of the airfoil portion to be arranged in the blade height direction and to perform convection-cooling of the trailing edge part, the plurality of cooling holes communicating with the cooling passage and penetrating the trailing edge part to open to a trailing-edge end surface. The turbine blade is a rotor blade. A relation of d_tip<d_root<d_mid is satisfied, where d_mid is an index indicating opening densities of the cooling holes in a center region including an intermediate position between a tip and a root of the airfoil portion in the blade height direction, d_tip is an index in a region positioned closer to the tip than the center region in the blade height direction, and d_root is an index in a region positioned closer to the root than the center region in the blade height direction. A formation region of the plurality of cooling holes in the trailing edge part includes the center region including the intermediate position between the tip and the root of the airfoil portion in the blade height direction, the center region having the constant index d_mid indicating the opening densities of the plurality of cooling holes, a tip region positioned closer to the tip than the center region in the blade height direction and closest to the tip in the formation region, the tip region having the constant index d_tip indicating the opening densities of the plurality of cooling holes, and a root region positioned closer to the root than the center region in the blade height direction and closest to the root in the formation region, the root region having the constant index d_root indicating the opening densities of the plurality of cooling holes.

The temperature of the gas flowing through the combustion gas flow passage where the rotor blade (turbine blade) is arranged tends to be higher in the center region than in the regions on the sides of the both end parts (the tip and the root) of the airfoil portion in the blade height direction. On the other hand, since the centrifugal force acts on the cooling medium in the cooling passage formed inside the airfoil portion of the rotor blade upon operation of the turbine, a pressure distribution may occur in which a pressure increases on the side of the tip of the airfoil portion in the cooling passage. In this case, in order to appropriately cool the trailing edge part, it is desirable to maximize flow rate of the cooling medium via the cooling holes in the center region in the blade height direction, and to decrease the variation in the supply flow rate of the cooling medium via the cooling holes between the region positioned on the side of the tip and the region positioned on the side of the root in the blade height direction.

In this regard, with the above configuration (4), since the opening densities of the cooling holes in the center region are higher than the opening densities of the cooling holes in the region positioned closer to the tip than the center region (tip region) and the region positioned closer to the root than the center region (root region), it is possible to increase the supply flow rate of the cooling medium via the cooling holes in the center region where the temperature of the gas flowing through the combustion gas flow passage is relatively high. In addition, in the above configuration (4), since the opening densities of the cooling holes are lower in the above-described tip region than in the above-described root region, it is possible to decrease a variation in the supply flow rate of the cooling medium via the cooling holes between the tip region and the root region even if the above-described pressure distribution occurs. Thus, it is possible to appropriately cool the trailing edge part of the turbine blade in accordance with the pressure distribution of the cooling passage.

(5) In some embodiments, in any one of the above configurations (1) to (4), the center region includes a plurality of cooling holes having the same diameter, and a tip region and a root region each include a plurality of cooling holes having the same diameter as the cooling holes in the center region, the tip region being positioned closer to a tip of the airfoil portion than the center region, the root region being positioned closer to a root of the airfoil portion than the center region.

(6) In some embodiments, in any one of the above configurations (1) to (5), the surface of the airfoil portion is an end surface of the trailing edge part.

(7) In some embodiments, in any one of the above configurations (1) to (6), the plurality of cooling holes are obliquely formed with respect to a plane orthogonal to the blade height direction.

With the above configuration (7), since the plurality of cooling holes are obliquely formed with respect to the plane directly running in the blade height direction, it is possible to elongate the cooling holes as compared with a case in which the cooling holes are formed in parallel to the plane orthogonal to the blade height direction. Thus, it is possible to effectively cool the trailing edge part of the turbine blade.

(8) In some embodiments, in any one of the above configurations (1) to (7), the plurality of cooling holes are formed in parallel to each other.

With the above configuration (8), since the plurality of cooling holes are formed in parallel to each other, it is possible to form more cooling holes in the airfoil portion than in a case in which the plurality of cooling holes are not in parallel to each other. Thus, it is possible to effectively cool the trailing edge part of the turbine blade.

(9) In some embodiments, in any one of the above configurations (1) to (8), the cooling passage is a last path of a serpentine flow passage formed inside the airfoil portion.

With the above configuration (9), since the plurality of cooling holes communicating with the last leg of the serpentine flow passage are open to the surface of the airfoil portion in the trailing edge part, it is possible to appropriately cool the trailing edge part of the turbine blade.

(10) In some embodiments, in any one of the above configurations (1) to (9), the turbine blade is a rotor blade, and the cooling passage has an outlet opening formed at a tip of the airfoil portion.

With the above configuration (10), since the rotor blade serving as the turbine blade has any one of the above configurations (1) to (9), it is possible to appropriately cool the trailing edge part of the rotor blade serving as the turbine blade.

(11) In some embodiments, in the above configuration (1) or (2), the turbine blade is a stator vane, and the cooling passage has an outlet opening formed on an inner shroud of the airfoil portion.

With the above configuration (11), since the stator vane serving as the turbine blade has the above configuration (1) to (2), it is possible to appropriately cool the trailing edge part of the stator vane serving as the turbine blade.

(12) A gas turbine according to at least one embodiment of the present invention includes the turbine blade according to any one of the above configurations (1) to (11), and a combustor for producing a combustion gas flowing through a combustion gas flow passage where the turbine blade is disposed.

With the above configuration (12), since the turbine blade has any one of the above configurations (1) to (11), it is possible to appropriately cool the trailing edge part of the turbine blade.

Advantageous Effects

According to at least one embodiment of the present invention, a turbine blade and a gas turbine are provided, which are capable of cooling a turbine blade effectively.

DETAILED DESCRIPTION

Embodiments of the present invention will now be described in detail with reference to the accompanying drawings. It is intended, however, that unless particularly identified, dimensions, materials, shapes, relative positions and the like of components described in the embodiments shall be interpreted as illustrative only and not intended to limit the scope of the present invention.

The basic idea of the present invention will be described below taking a turbine rotor blade as a representative example.

Figure 20A:
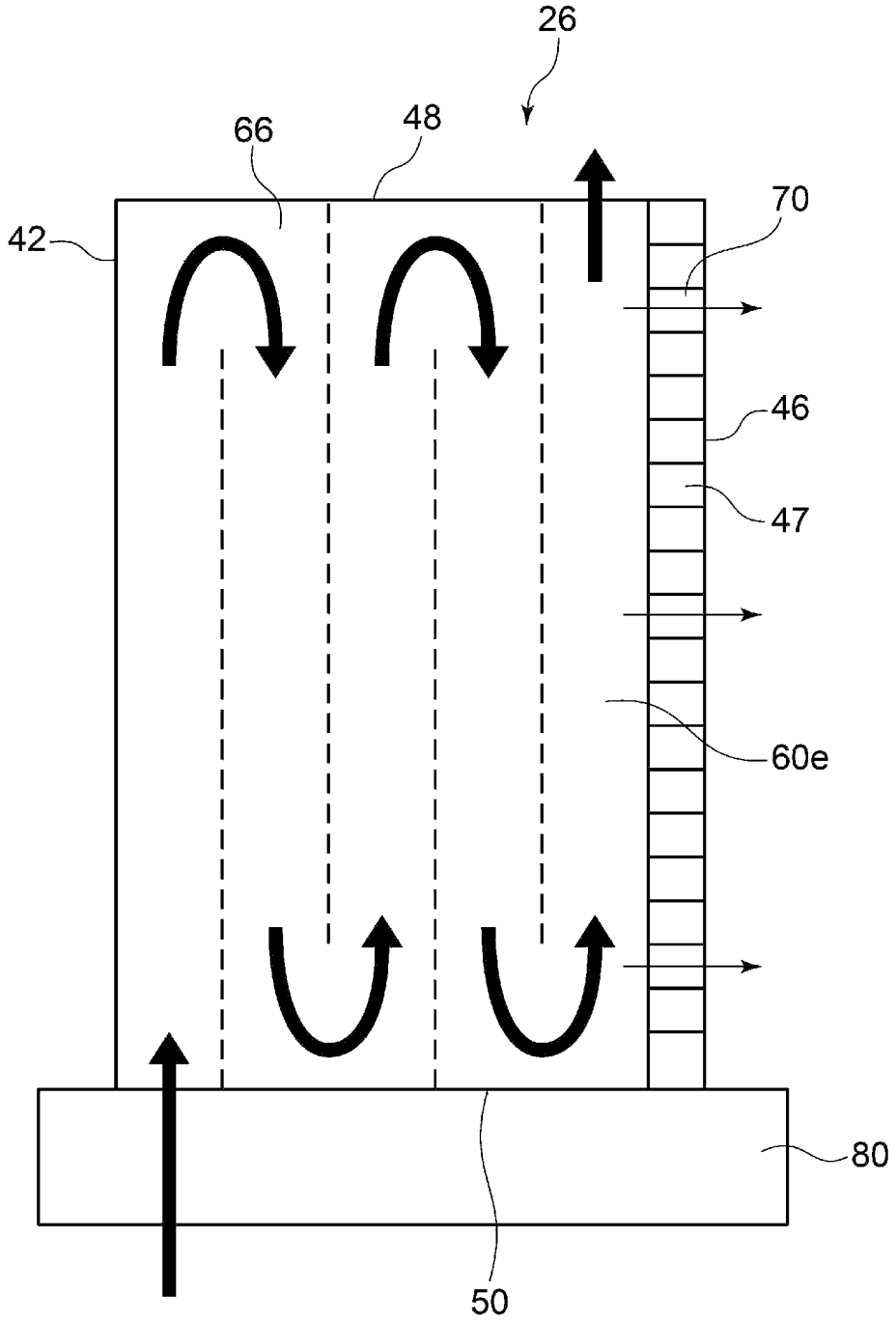
FIG. 20A is a schematic view of the turbine rotor blade for explaining the basic configuration of the present invention.
Figure 20B:
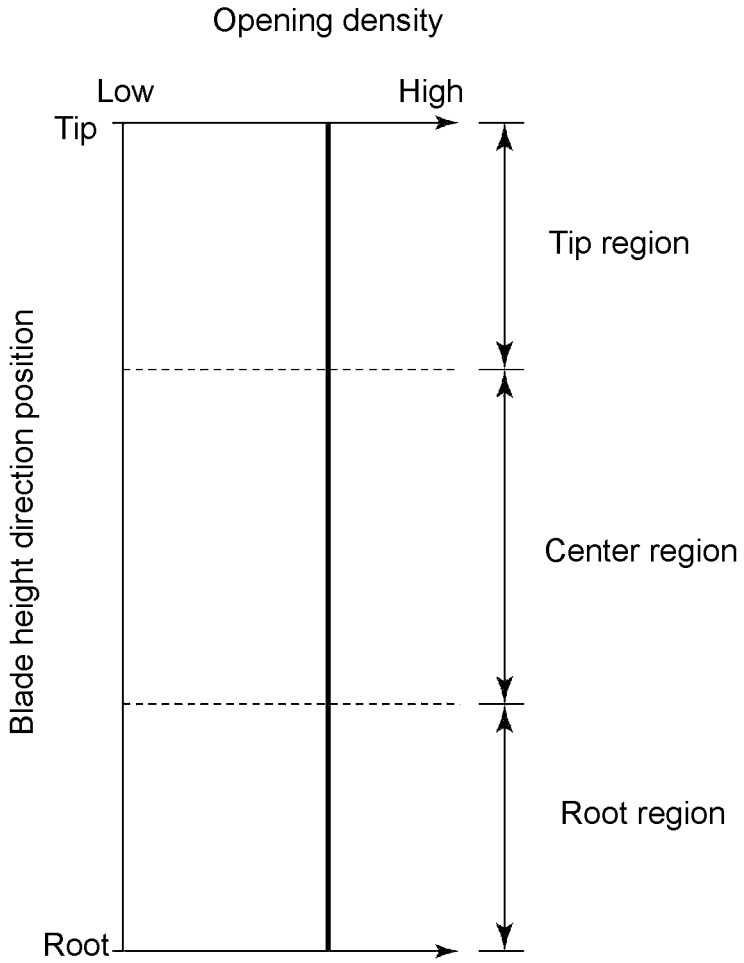
FIG. 20B is a view showing an opening density distribution of cooling holes of a conventional blade.

A rotor blade 26 of a gas turbine is fixed to a high-speed rotating rotor 8 (see FIG. 1) and operates in an atmosphere of a high-temperature combustion gas, and thus an airfoil portion 42 thereof is cooled by using a cooling medium. As shown in FIG. 20A, a cooling passage 66 is formed inside the airfoil portion 42 of the rotor blade 26, and the cooling medium supplied from the side of a root 50 flows in the cooling passage 66 to cool the airfoil portion 42 and is discharged into a combustion gas from a tip 48 of a last path 60*e* on the side of a trailing edge 46. In addition, the cooling medium flows through the last path 60*e*, and is supplied to a plurality of cooling holes 70 formed downstream in the axial direction of the rotor 8 of a trailing edge part 47 and having openings to the trailing edge 46. The cooling medium performs convection-cooling of the trailing edge part 47 in the process of flowing through the cooling holes 70 and being discharged into the combustion gas. Moreover, regarding cooling holes disclosed in Patent Document 1, as shown in FIG. 20B, the cooling holes 70 having the same hole diameter are arranged at the same pitch over the entire length in a blade height direction of the trailing edge part 47 to uniform opening densities of the cooling holes 70 in the blade height direction. This is an example of the arrangement of the conventional cooling holes.

Figure 20C:
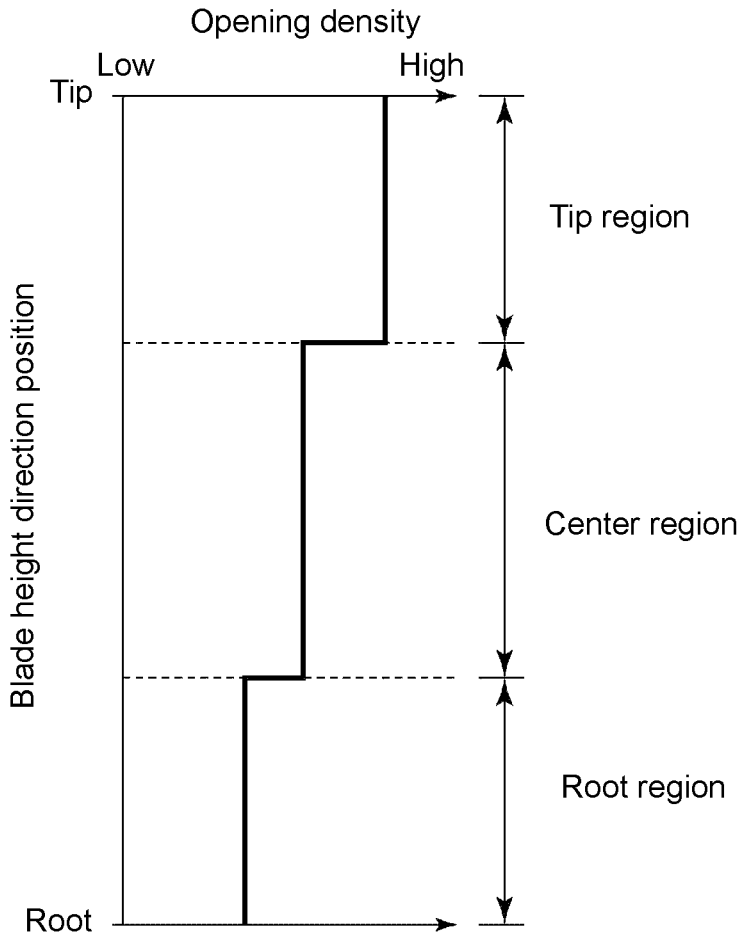
FIG. 20C is a view showing an example of the opening density distribution of the cooling holes of the basic configuration of the present invention.

The cooling medium is heated from the airfoil portion 42 in the process of flowing through the cooling passage 66 upstream of the last path 60*e* and flows into the last path 60*e* on the side of the trailing edge 46. The cooling medium receives heat from the airfoil portion 42 to be further heated up in the process of flowing from the root 50 on an inlet side to the tip 48 on an outlet side in a flow direction of the last path 60*e*. Therefore, the temperature of the cooling medium flowing through the last path 60*e* in a tip region of the airfoil portion 42 increases, which may result in strict use conditions. In the case of the rotor blade 26, a metal temperature close to a service temperature limit determined from an oxidation thinning allowance is obtained in the tip region outside in the blade height direction (outside in the radial direction) of the airfoil portion 42, and it is necessary to cool the airfoil portion 42 so as not to exceed the service temperature limit. In the case of the conventional blade structure described above, as a result of heating up the cooling medium, the metal temperature is the highest in the tip region of the last path 60*e* of the airfoil portion 42, is lower in a center region of the airfoil portion 42 than in the tip region, and is further lower in a root region than in the center region. Therefore, from the perspective of overheat of the airfoil portion 42 by heating up the cooling medium, it is desirable to select the opening densities of the cooling holes 70 arranged in the blade height direction so as to obtain an uniform metal temperature distribution without increasing variations in the metal temperature of the respective regions. That is, it is desirable to set the opening densities of the cooling holes 70 in the tip region outside in the blade height direction of the rotor blade 26, which is a downstream region in the flow direction of the cooling medium, to the densest distribution, set the opening densities of the cooling holes 70 in the center region to a medium distribution, and set the opening densities of the cooling holes 70 in the root region to the non-densest distribution. Based on the above-described idea, FIG. 20C shows an example of a schematic view of the cooling holes according to an embodiment of the present invention.

On the other hand, centrifuge-based creep strengths in the center region and the root region of the last path 60*e* also need to be considered. In the case of the rotor blade 26 fixed to and rotating integrally with the rotating rotor 8 at a high speed, a centrifugal force acts on the airfoil portion 42, generating a tension stress in the blade height direction of a blade wall. FIG. 20E shows an example of a creep limit curve of a blade material. The ordinate indicates an allowable stress, and the abscissa indicates a metal temperature. A downward curve is obtained, which indicates that the allowable stress decreases as the metal temperature increases. A creep rupture of the airfoil portion 42 does not occur in a region below the creep limit curve with a small stress. However, the airfoil portion 42 may be damaged due to the creep rupture in a region above the curve with a large stress. The creep rupture does not occur in the tip region of the airfoil portion 42 on which a small centrifugal force acts. However, the possibility of the creep rupture needs to be considered for the center region and the root region of the airfoil portion 42 even if the metal temperature in those regions is lower than in the tip region.

Figure 20D:
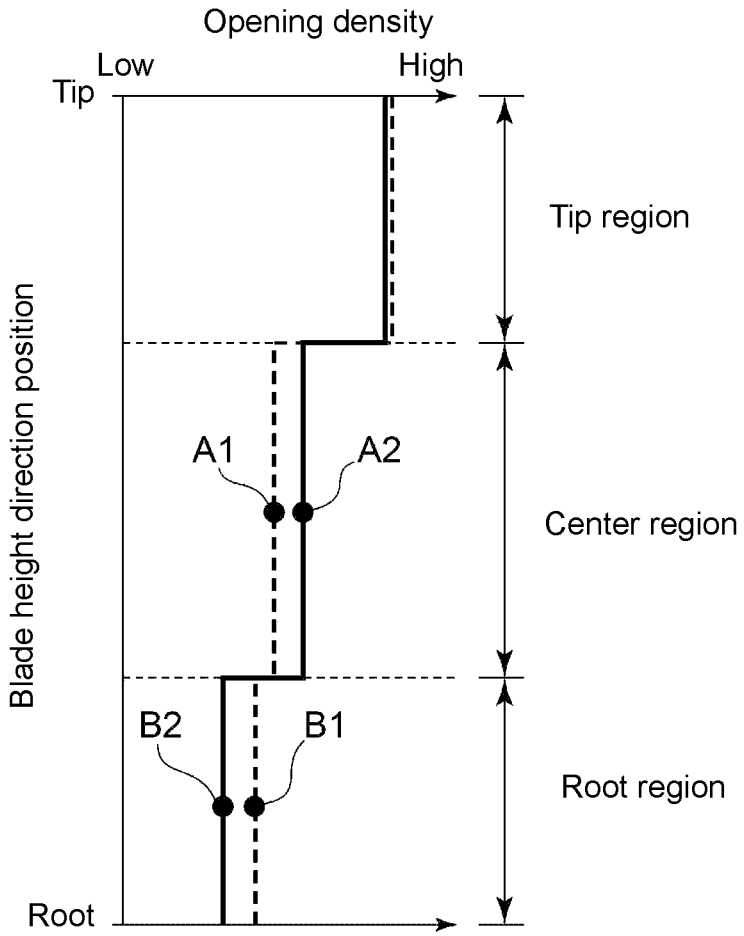
FIG. 20D is a view showing an example in which the opening density distribution of the cooling holes of the basic configuration of the present invention is corrected.
Figure 20E:
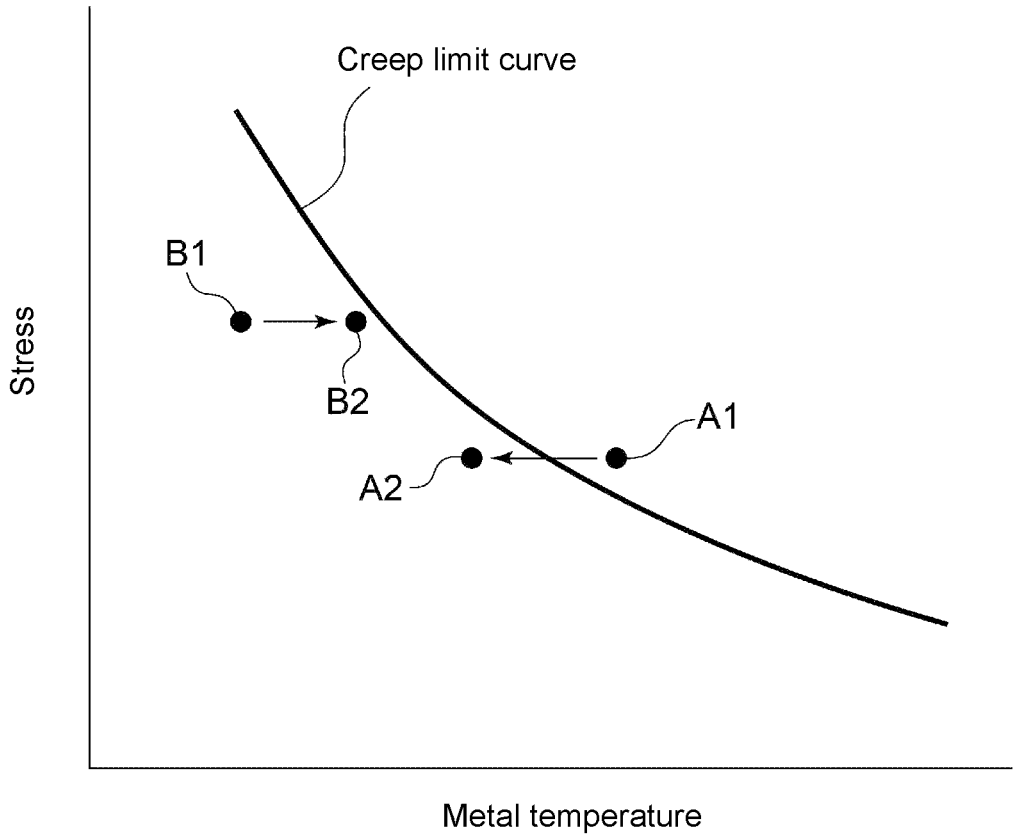
FIG. 20E is a graph of a creep limit curve.

FIGS. 20D and 20E each show an example of a case in which the creep strengths in the center region and the root region become critical. A description will be given by taking a point A1 of the center region and a point B1 of the root region as an example in FIG. 20E. The example shows a state in which the point A1 exceeds a creep limit, and a state in which the point B1 is within the creep limit. Whether the point is within the creep limit is depends on, for example, the size and the wall thickness of the blade, the metal temperature, and the like in a corresponding portion. In the case of the example shown in the present embodiment, since the creep limit is exceeded at a position of the point A1 in the center region, it is necessary to decrease the metal temperature. That is, the opening densities of the cooling holes 70 in the center region are further increased to enhance cooling, thereby decreasing the metal temperature at a position of a point A2. On the other hand, if the opening densities of the cooling holes 70 in the center region are increased, the flow rate of the cooling medium flowing through the cooling holes 70 in the center region may be increased, and the flow rate of the cooling medium flowing through the cooling holes 70 in the root region may be decreased. Therefore, although the metal temperature in the root region increases to that at a point B2 if cooling in the center region is enhanced, said opening densities can be selected as long as a position of the point B2 is within the creep limit as shown in FIG. 20E. The tip region can similarly be adjusted. That is, it is possible to reduce the flow rate of the cooling medium flowing through the cooling holes 70 in the tip region if the opening densities of the cooling holes 70 in the tip region are decreased. It is possible to increase the flow rate of the cooling medium flowing through the cooling holes 70 in the center region to enhance cooling in the center region by decreasing the flow rate of the cooling medium without the metal temperature in the tip region exceeding the aforementioned service temperature limit. FIG. 20D shows an example in which the opening densities of the cooling holes 70 are corrected in such a procedure. A solid line indicates opening densities after adjustment, and a dashed line indicates opening densities before adjustment. It is possible to determine appropriate opening densities for the cooling holes in the respective regions by confirming that all of the respective regions are within the service temperature limit or the creep limit.

Figure 20F:
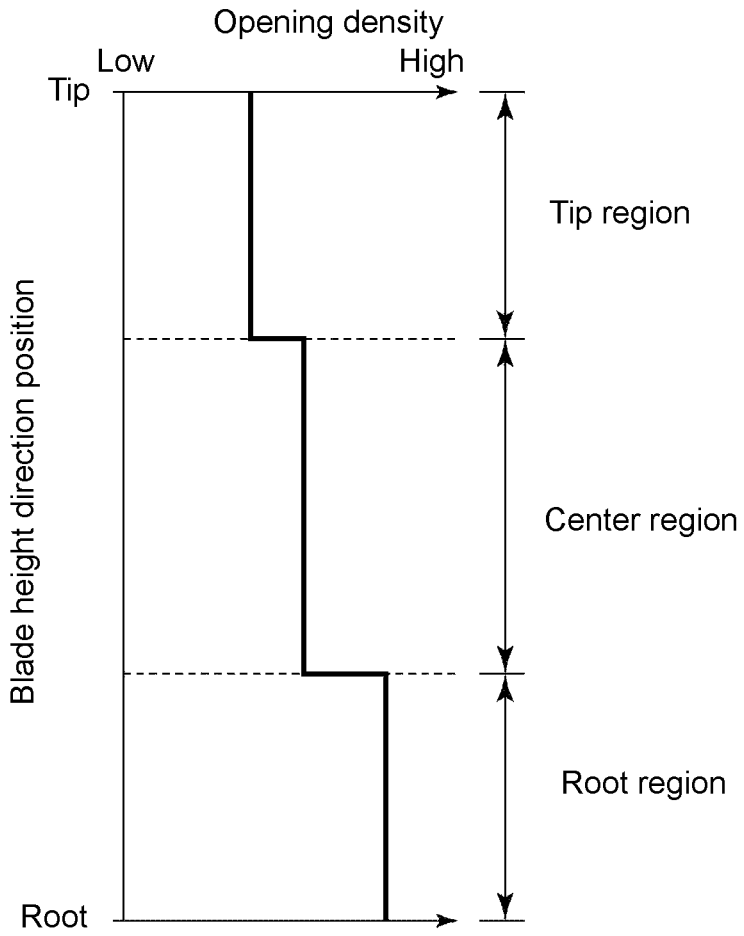
FIG. 20F is a view of another example showing the opening density distribution of the cooling holes of the basic configuration of the present invention.

Next, in the case of the rotor blade 26 having the metal temperature on the side of the tip 48 lower than the service temperature limit and relatively having a margin for the metal temperature on the side of the tip 48, the centrifugal force which acts on the cooling medium flowing through the last path 60*e* may influence the arrangement of the cooling holes 70. An example of this will be described below. As shown in FIG. 20A, the centrifugal force acts on the cooling medium flowing through the last path 60*e* of the airfoil portion 42 in the same direction as the flow direction of the cooling medium. That is, due to the action of the centrifugal force, a pressure gradient occurs in the cooling medium, in which a pressure increases from the side of the root 50 toward the side of the tip 48. Therefore, in the arrangement of the cooling holes with the uniform opening densities shown in FIG. 20B, the flow rate of the cooling medium discharged into the combustion gas from an outlet opening 64 at the tip 48 of the airfoil portion 42 or the cooling holes 70 in the tip region exclusively increases, and the flow rate of the cooling medium supplied to the cooling holes 70 in the center region and the root region decreases, which may result in insufficient cooling of the center region and the root region. In this case, it is necessary to reduce the flow rate of the cooling medium discharged into the combustion gas from the outlet opening 64 on the side of the tip 48 or the cooling holes 70 in the tip region by decreasing the opening densities stepwise from the root region toward the tip region, and to increase the amount of the cooling medium supplied to the cooling holes 70 in the center region and the root region. By thus selecting the appropriate opening densities of the cooling holes, it is possible to uniform the metal temperature in the respective regions. FIG. 20F shows an example of opening density distribution of the cooling holes 70 considering the influence of the centrifugal force.

It is possible to avoid damage to the blade associated with, for example, oxidation thinning of the trailing edge part and the creep rupture, and to improve reliability of the blade by determining the opening densities in the respective regions based on the above-described ideas. The above description is given by taking the turbine rotor blade as an example. However, the above description is also applicable to a turbine stator vane except that the centrifugal force does not act. Next, specific embodiments of the present invention will be described.

First, a gas turbine to which the turbine blade is applied according to some embodiments will be described.

Figure 1:
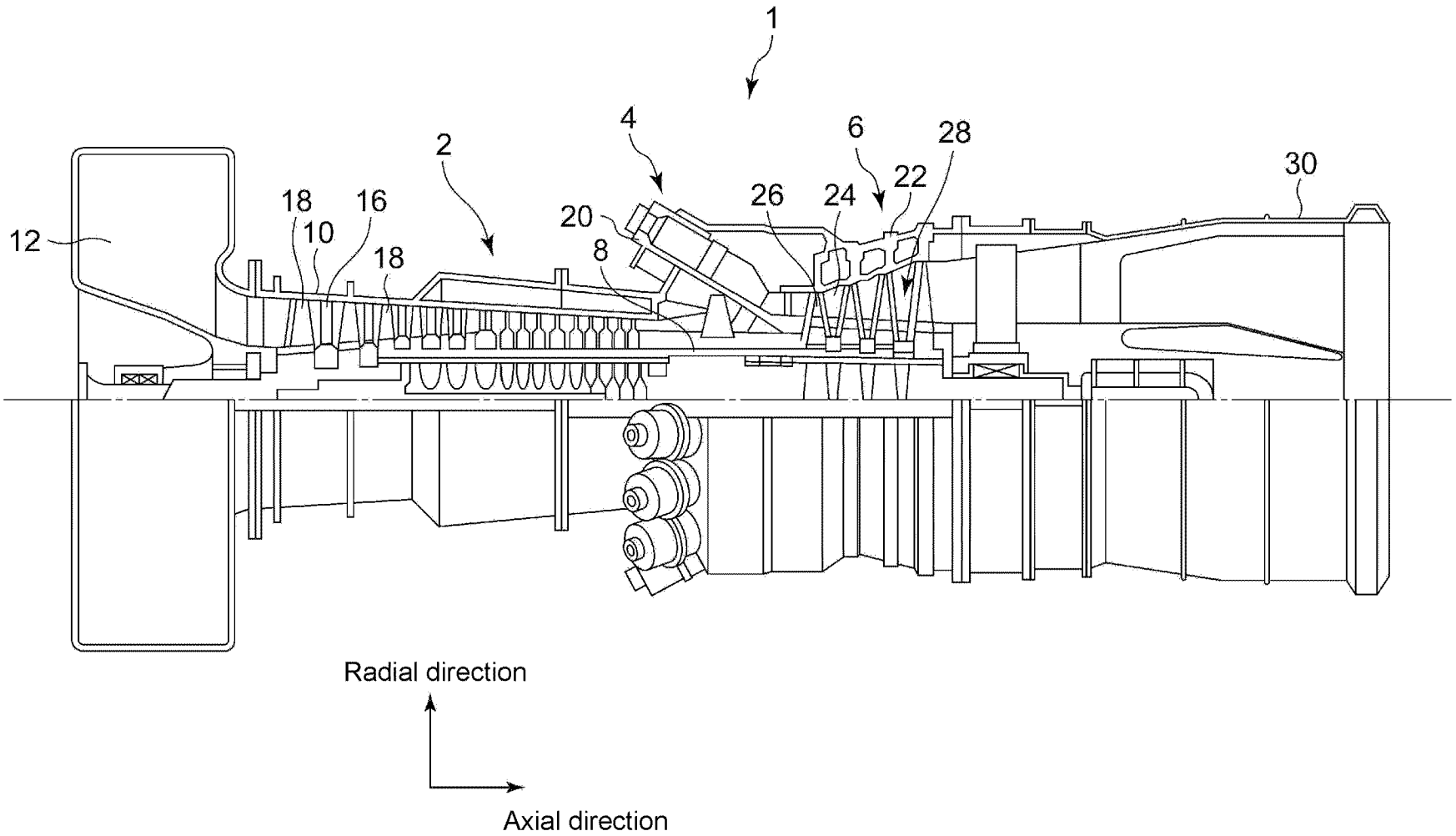
FIG. 1 is a schematic configuration view of a gas turbine to which a turbine blade is applied according to an embodiment.

FIG. 1 is a schematic configuration view of the gas turbine to which the turbine blade is applied according to an embodiment. As shown in FIG. 1, the gas turbine 1 includes a compressor 2 for generating compressed air, a combustor 4 for producing the combustion gas from the compressed air and fuel, and a turbine 6 configured to be rotary driven by the combustion gas. In the case of the gas turbine 1 for power generation, a generator (not shown) is connected to the turbine 6.

The compressor 2 includes a plurality of stator vanes 16 fixed to the side of a compressor casing 10 and a plurality of rotor blades 18 implanted on the rotor 8 so as to be arranged alternately with respect to the stator vanes 16.

Intake air from an air inlet 12 is sent to the compressor 2, and passes through the plurality of stator vanes 16 and the plurality of rotor blades 18 to be compressed, turning into compressed air having a high temperature and a high pressure.

The combustor 4 is supplied with fuel and the compressed air generated by the compressor 2, and combusts the fuel to produce the combustion gas which serves as a working fluid of the turbine 6. As shown in FIG. 1, a plurality of combustors 4 may circumferentially be arranged in the casing 20 centering around the rotor.

The turbine 6 includes a combustion gas flow passage 28 formed in a turbine casing 22, and includes a plurality of stator vanes 24 and rotor blades 26 disposed in the combustion gas flow passage 28.

Each of the stator vanes 24 is fixed to the side of the turbine casing 22. The plurality of stator vanes 24 arranged in the circumferential direction of the rotor 8 form a stator vane row. Moreover, each of the rotor blades 26 is implanted on the rotor 8. The plurality of rotor blades 26 arranged in the circumferential direction of the rotor 8 form a rotor blade row. The stator vane row and the rotor blade row are alternately arranged in the axial direction of the rotor 8.

In the turbine 6, the combustion gas flowing into the combustion gas flow passage 28 from the combustor 4 passes through the plurality of stator vanes 24 and the plurality of rotor blades 26, rotary driving the rotor 8. Consequently, the generator connected to the rotor 8 is driven to generate power. The combustion gas having driven the turbine 6 is discharged outside via an exhaust chamber 30.

In some embodiments, at least either of the rotor blades 26 or the stator vanes 24 of the turbine 6 are turbine blades 40 to be described below.

Figure 2:
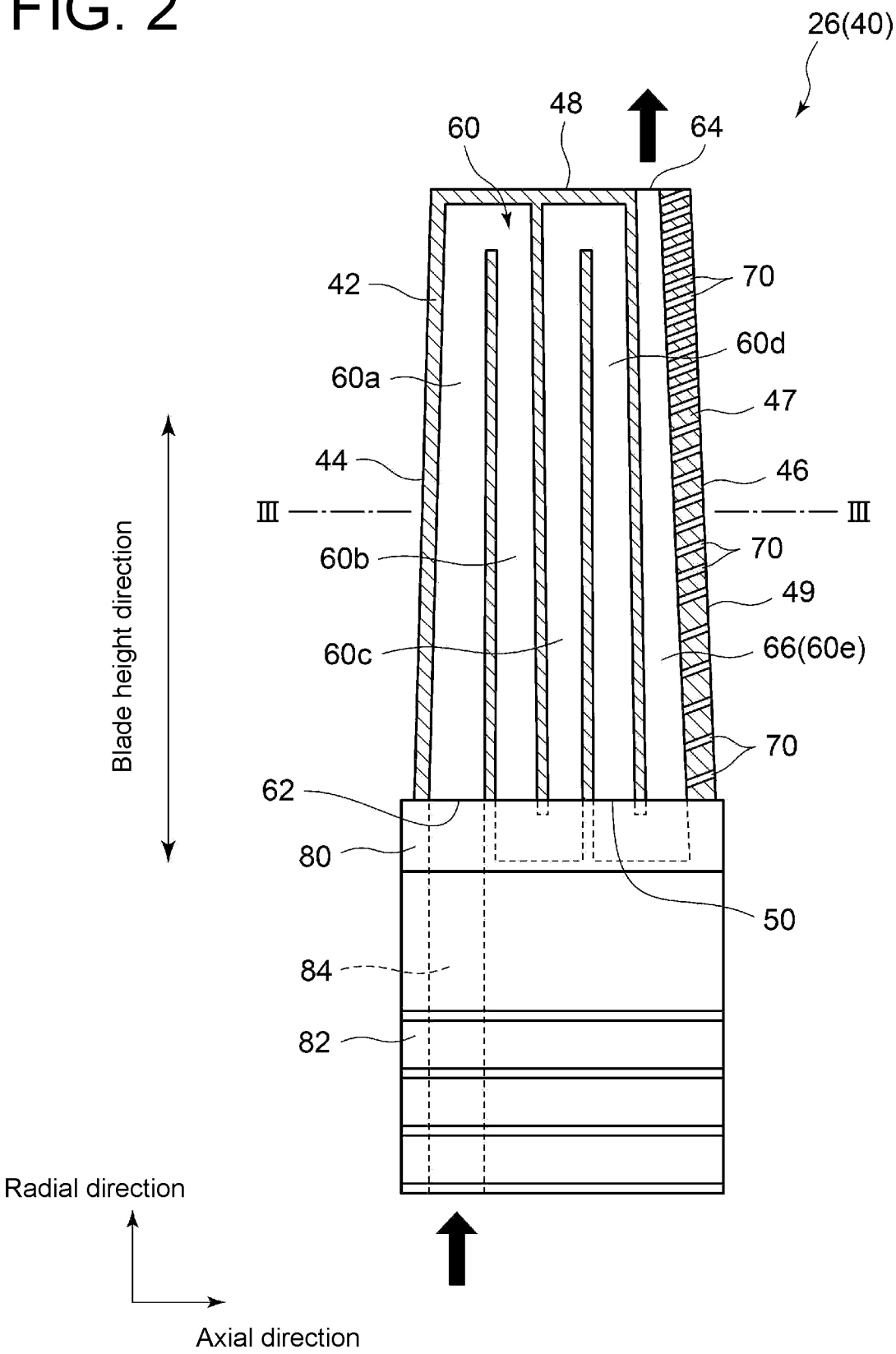
FIG. 2 is a partial cross-sectional view of a rotor blade serving as a turbine blade according to an embodiment.
Figure 3:
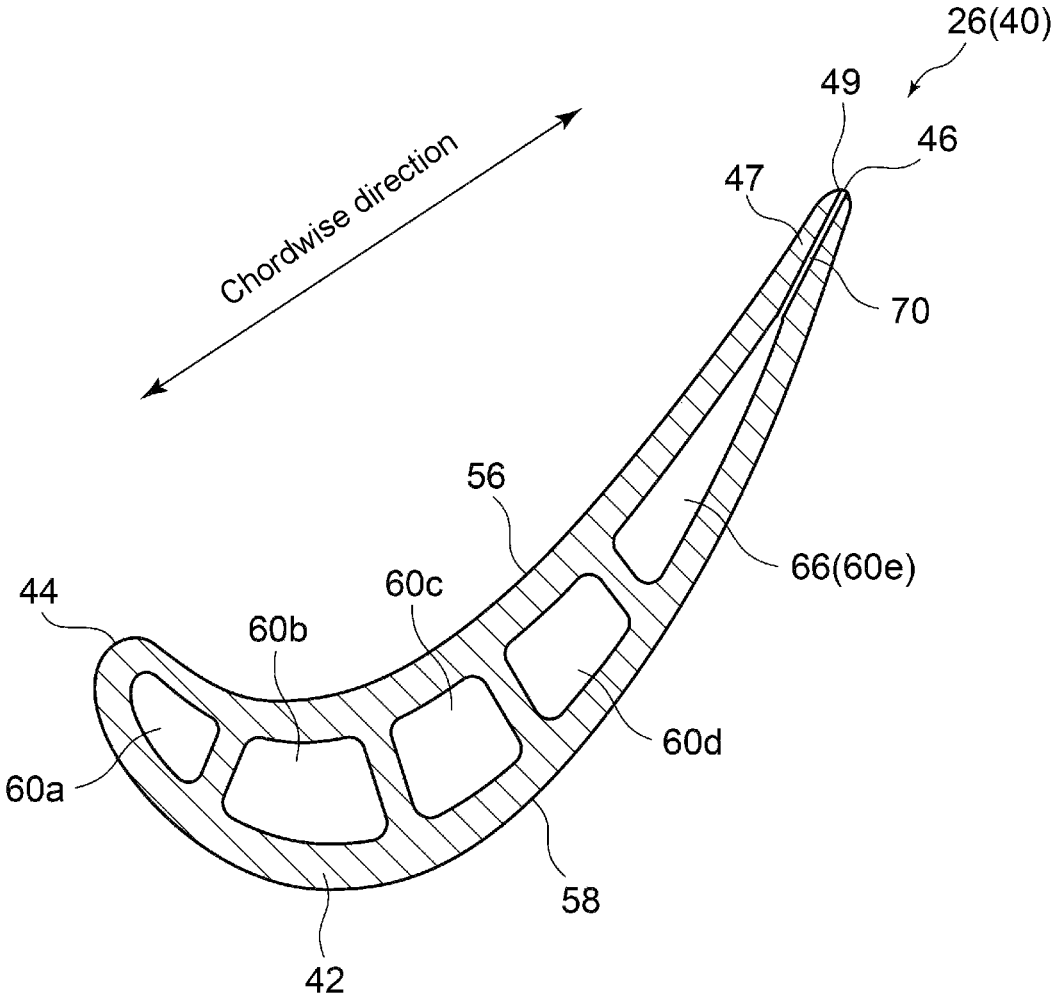
FIG. 3 is a cross-sectional view of the rotor blade (turbine blade) shown in FIG. 2, taken along line III-III.
Figure 4:
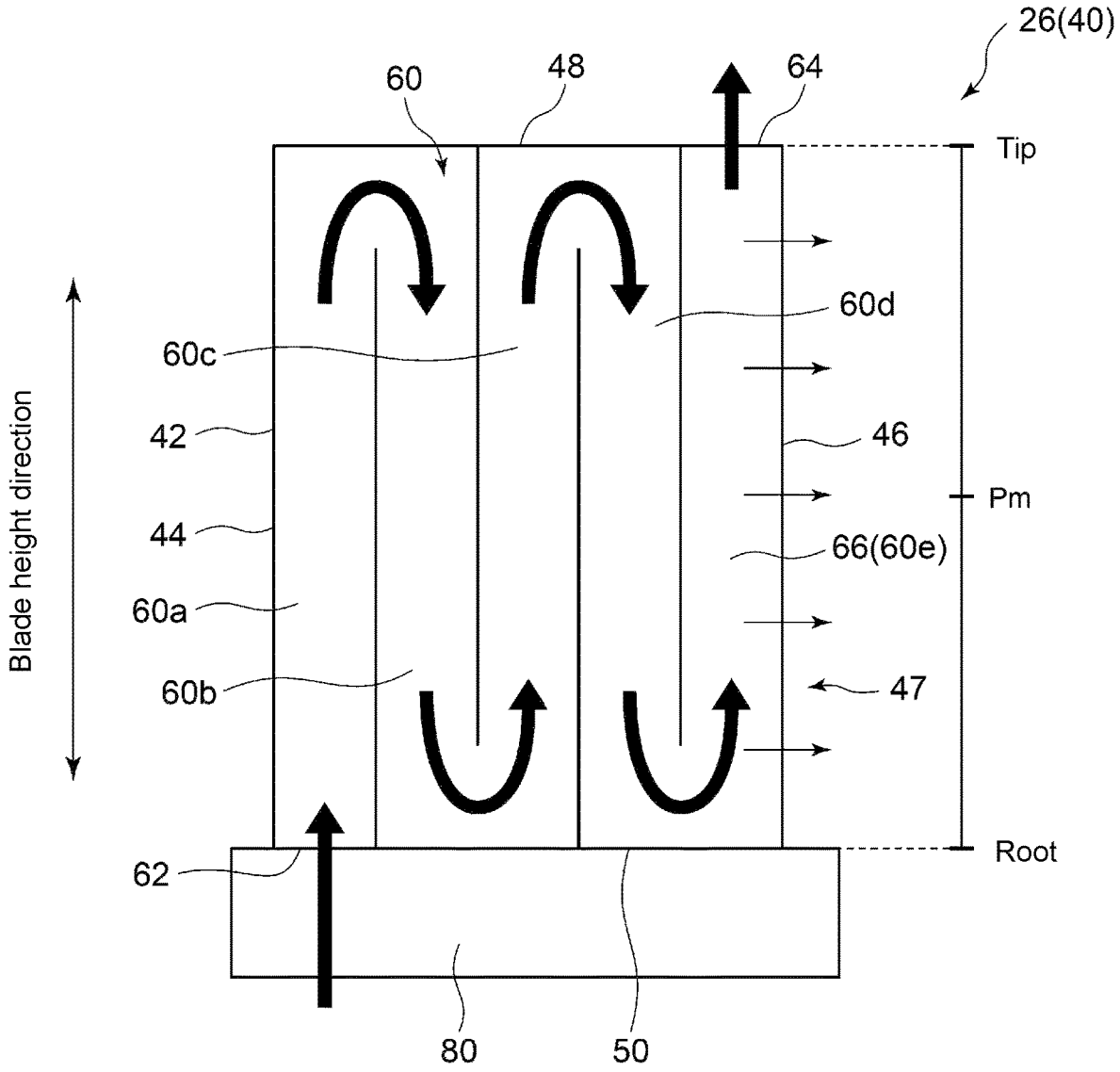
FIG. 4 is a schematic cross-sectional view of the rotor blade (turbine blade) shown in FIG. 2.
Figure 5:
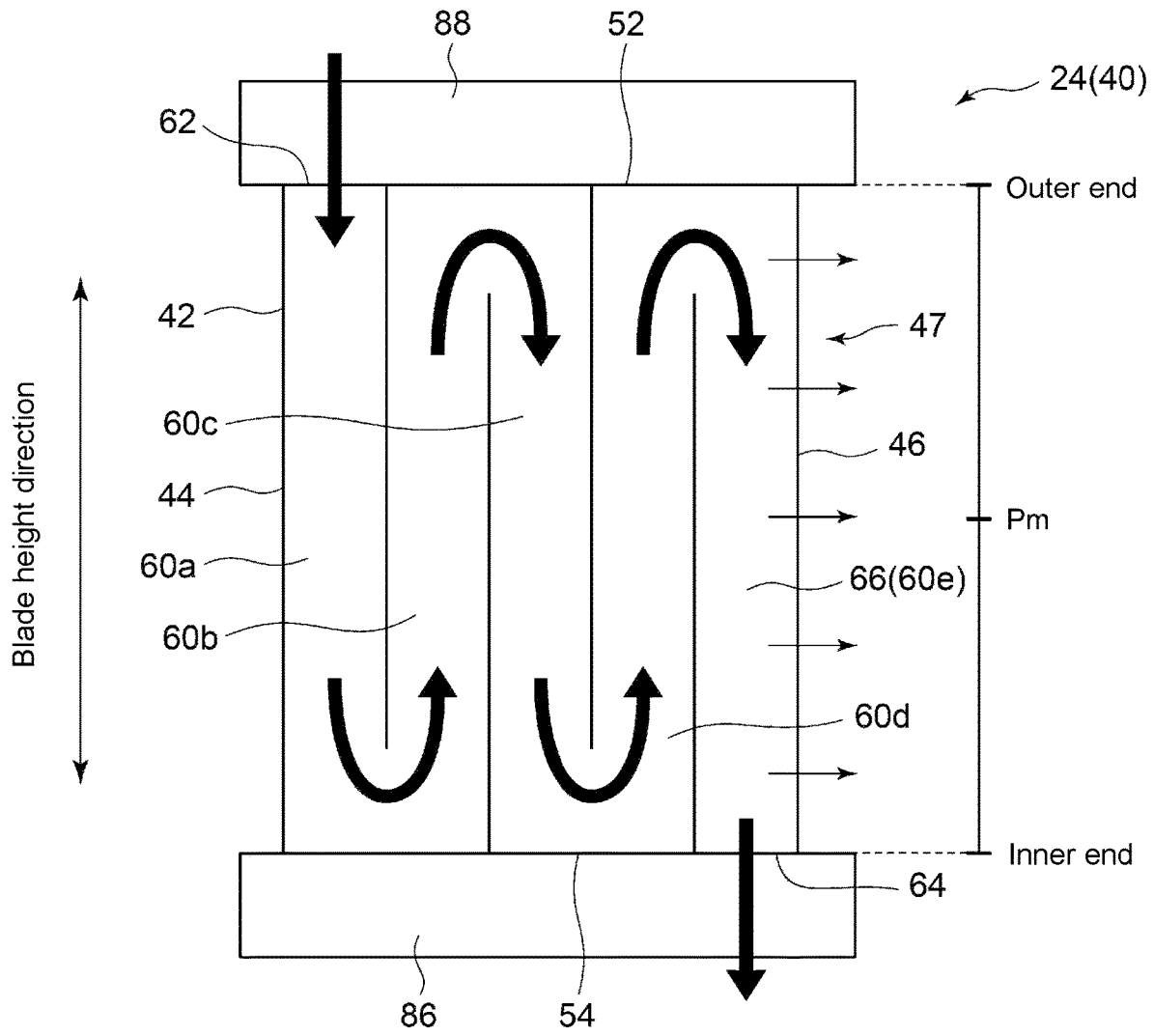
FIG. 5 is a schematic cross-sectional view of a stator vane serving as the turbine blade according to an embodiment.

FIG. 2 is a partial cross-sectional view of the rotor blade 26 serving as the turbine blade 40 according to an embodiment. FIG. 2 shows the cross section of a part of the airfoil portion 42 of the rotor blade 26. FIG. 3 is a cross-sectional view of the turbine blade 40 shown in FIG. 2, taken along line FIG. 4 is a schematic cross-sectional view of the rotor blade 26 (turbine blade 40) shown in FIG. 2. FIG. 5 is a schematic cross-sectional view of the stator vane 24 serving as the turbine blade 40 according to an embodiment. In FIGS. 4 and 5, a part of the configuration of the turbine blade 40 is not illustrated. Arrows in the views each indicate the flow direction of the cooling medium.

As shown in FIGS. 2 and 4, the turbine blade 40 serving as the rotor blade 26 according to an embodiment includes the airfoil portion 42, a platform 80, and a blade root portion 82. The blade root portion 82 is embedded in the rotor 8 (see FIG. 1). The rotor blade 26 rotates together with the rotor 8. The platform 80 is formed integrally with the blade root portion 82. The airfoil portion 42 is disposed so as to extend in the radial direction of the rotor 8 (may simply be referred to as the "radial direction" hereinafter), and includes the root 50 fixed to the platform 80 and the tip 48 positioned on the side opposite to the root 50 in the radial direction.

In some embodiments, the turbine blade 40 may be the stator vane 24.

As shown in FIG. 5, the turbine blade 40 serving as the stator vane 24 includes the airfoil portion 42, an inner shroud 86 positioned radially inward with respect to the airfoil portion 42, and an outer shroud 88 positioned radially outward with respect to the airfoil portion 42. The outer shroud 88 is supported by the turbine casing 22, and the stator vane 24 is supported by the turbine casing 22 via the outer shroud 88. The airfoil portion 42 has an outer end 52 positioned on the side of the outer shroud 88 (that is, radially outward) and an inner end 54 positioned on the side of the inner shroud 86 (that is, radially inward).

As shown in FIGS. 2 to 5, the airfoil portion 42 of the turbine blade 40 has a leading edge 44 and a trailing edge 46 extending from the root 50 to the tip 48 in the case of the rotor blade 26 (see FIGS. 2 to 4), and extending from the outer end 52 to the inner end 54 in the case of the stator vane 24 (see FIG. 5). Moreover, the blade surface of the airfoil portion 42 is formed by a pressure surface (concave surface) 56 and a suction surface (convex surface) 58 (see FIG. 3) extending in the blade height direction between the root 50 and the tip 48 in the case of the rotor blade 26 and between the outer end 52 and the inner end 54 in the case of the stator vane 24.

The cooling passage 66 extending in the blade height direction is formed inside the airfoil portion 42. The cooling passage 66 is a flow passage for flowing the cooling medium (for example, air or the like) to cool the turbine blade 40.

In the exemplary embodiments shown in FIGS. 2 to 5, the cooling passage 66 partially forms a serpentine flow passage 60 disposed inside the airfoil portion 42.

The serpentine flow passage 60 shown in FIGS. 2 to 5 includes a plurality of paths 60*a* to 60*e* extending in the blade height direction and are arranged in this order from the side of the leading edge 44 toward the side of the trailing edge 46. The paths adjacent to each other (for example, the path 60*a* and the path 60*b*) of the plurality of paths 60*a* to 60*e* are connected to each other on the side of the tip 48 or the side of the root 50. In the connection part, a return flow passage with flow direction of the cooling medium being reversely folded in the blade height direction is obtained, and the serpentine flow passage 60 has a meander shape as a whole.

In the exemplary embodiments shown in FIGS. 2 to 5, the cooling passage 66 is the last path 60*e* of the serpentine flow passage 60. Of the plurality of paths 60*a* to 60*e* constituting the serpentine flow passage 60, the last path 60*e* is typically disposed on the side of the trailing edge 46 most downstream in flow direction of the cooling medium.

In the case in which the turbine blade 40 is the rotor blade 26, the cooling medium is introduced into, for example, an inner flow passage 84 formed inside the blade root portion 82 and the serpentine flow passage 60 via an inlet opening 62 disposed on the side of the root 50 of the airfoil portion 42 (see FIGS. 2 and 4), and sequentially flows through the plurality of paths 60*a* to 60*e*. Then, the cooling medium flowing through the last path 60*e* most downstream in flow direction of the cooling medium of the plurality of paths 60*a* to 60*e* flows out to the combustion gas flow passage 28 external to the turbine blade 40 via the outlet opening 64 disposed on the side of the tip 48 of the airfoil portion 42.

In the case in which the turbine blade 40 is the stator vane 24, the cooling medium is introduced into, for example, an inner flow passage (not shown) formed inside the outer shroud 88 and the serpentine flow passage 60 via the inlet opening 62 disposed on the side of the outer end 52 of the airfoil portion 42 (see FIG. 5), and sequentially flows through the plurality of paths 60*a* to 60*e*. Then, the cooling medium flowing through the last path 60*e* most downstream in flow direction of the cooling medium of the plurality of paths 60*a* to 60*e* flows out to the combustion gas flow passage 28 external to the turbine blade 40 via the outlet opening 64 disposed on the side of the inner end 54 (the side of the inner shroud 86) of the airfoil portion 42.

As the cooling medium for cooling the turbine blade 40, for example, a part of the compressed air obtained by the compressor 2 (see FIG. 1) may be directed to the cooling passage 66. The compressed air from the compressor 2 may be supplied to the cooling passage 66 after being cooled by heat exchange with a cold source.

The shape of the serpentine flow passage 60 is not limited to shapes shown in FIGS. 2 and 3. For example, a plurality of serpentine flow passages may be formed inside the airfoil portion 42 of the one turbine blade 40. Alternatively, the serpentine flow passage 60 may be branched into a plurality of flow passages at a branch point on the serpentine flow passage 60.

As shown in FIGS. 2 and 3, in the trailing edge part 47 (a part including the trailing edge 46) of the airfoil portion 42, the plurality of cooling holes 70 are formed to be arranged in the blade height direction. The plurality of cooling holes 70 communicate with the cooling passage 66 (the last path 60*e* of the serpentine flow passage 60 in the illustrated example) formed inside the airfoil portion 42 and open to the surface of the airfoil portion 42 in the trailing edge part 47 of the airfoil portion 42.

The cooling medium flowing through the cooling passage 66 partially passes through the cooling holes 70 and flows out to the combustion gas flow passage 28 external to the turbine blade 40 from the opening of the trailing edge part 47 of the airfoil portion 42. The cooling medium thus passes through the cooling holes 70, performing convection-cooling of the trailing edge part 47 of the airfoil portion 42.

The surface of the trailing edge part 47 of the airfoil portion 42 may be a surface including the trailing edge 46 of the airfoil portion 42, or the surface of the blade surface in the vicinity of the trailing edge 46 or the surface of a trailing-edge end surface 49. The surface of the airfoil portion 42 in the trailing edge part 47 of the airfoil portion 42 may be the surface of the airfoil portion 42 in a 10% of a part of the airfoil portion 42 on the side of the trailing edge 46 including the trailing edge 46 in a chordwise direction connecting the leading edge 44 and the trailing edge 46 (see FIG. 3). The trailing-edge end surface 49 refers to an end surface with the pressure surface (concave side) 56 and the suction surface (convex side) intersecting at the terminating end of the trailing edge 46 downstream in the axial direction of the rotor 8, and facing downstream in the axial direction of the rotor 8.

The plurality of cooling holes 70 have a non-constant and non-uniform opening density distribution in the blade height direction.

The opening density distribution of the plurality of cooling holes 70 according to some embodiments will be described below.

Figure 9:
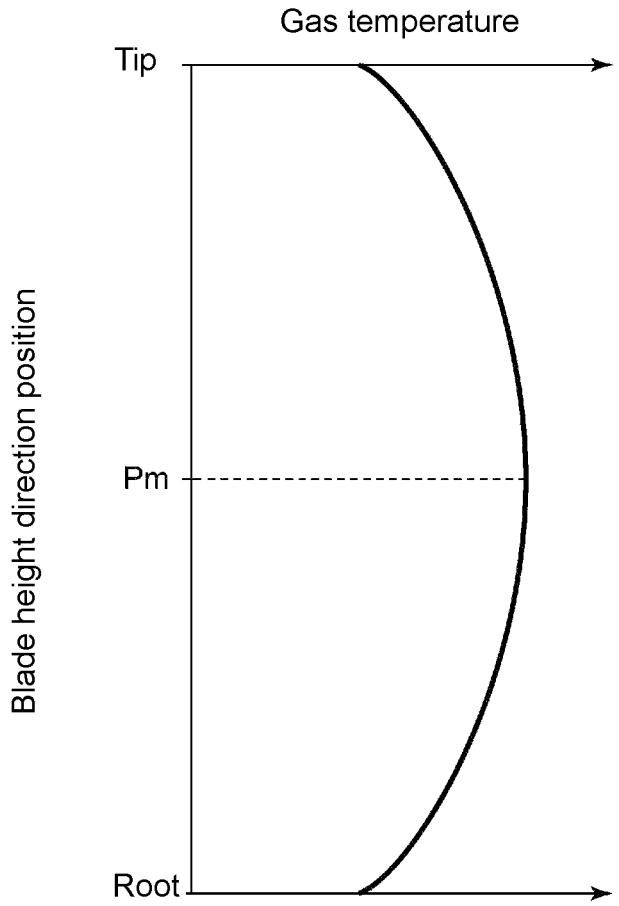
FIG. 9 is a graph showing an example of a temperature distribution of a combustion gas in a blade height direction.
Figure 10:
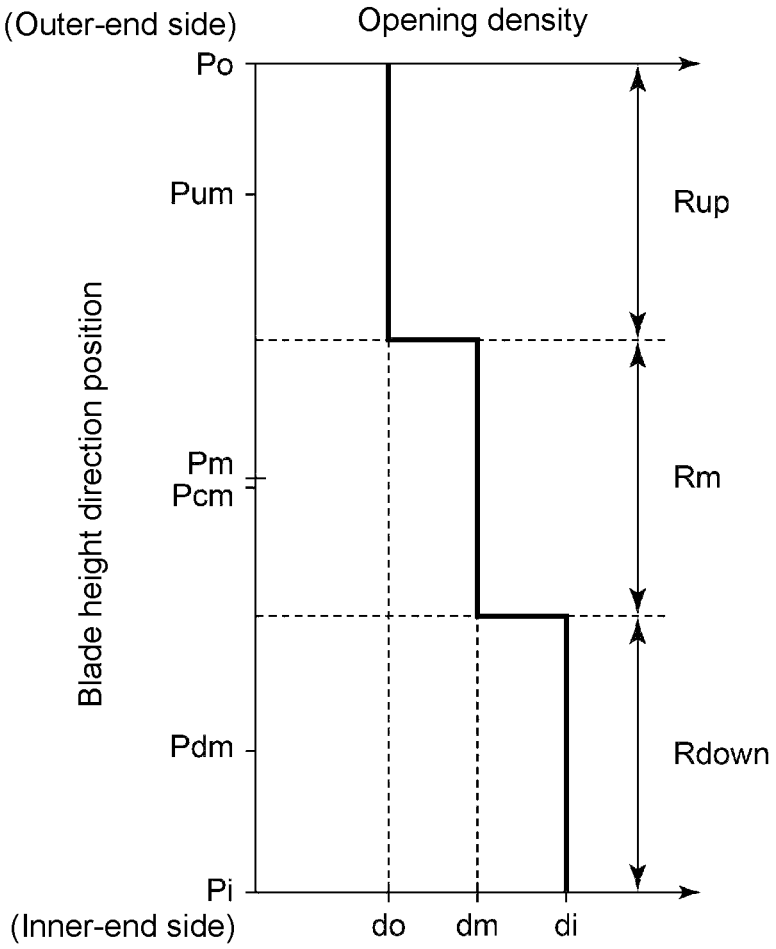
FIG. 10 is a graph showing an example of an opening density distribution of a trailing edge part of a stator vane (turbine blade) according to an embodiment.
Figure 11:
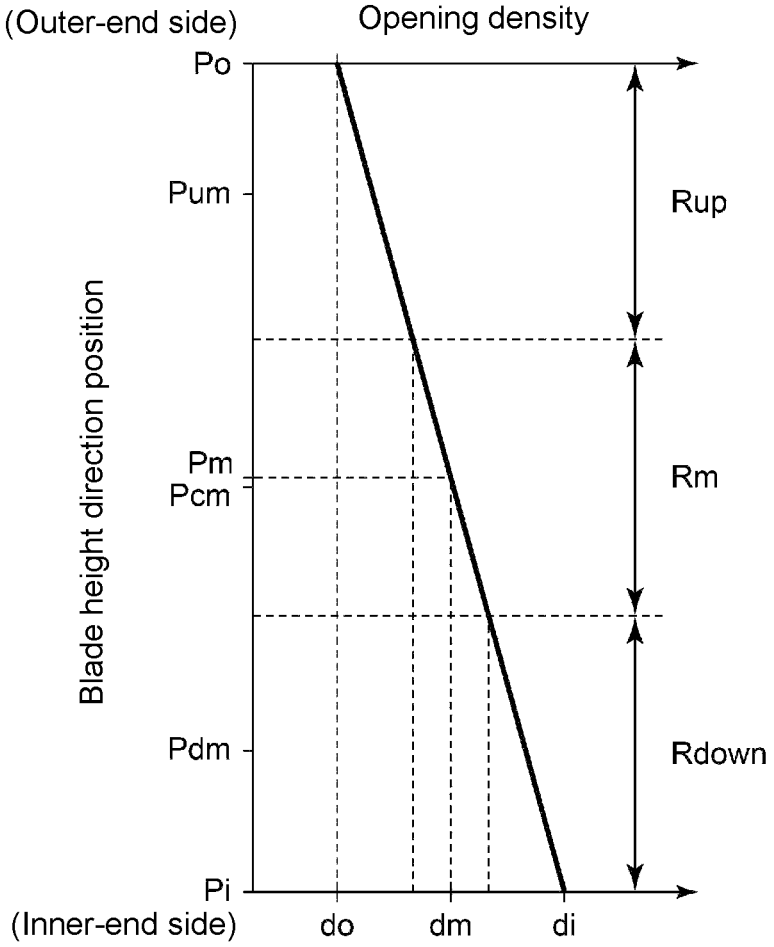
FIG. 11 is a graph showing an example of the opening density distribution of the trailing edge part of the stator vane (turbine blade) according to an embodiment.
Figure 12:
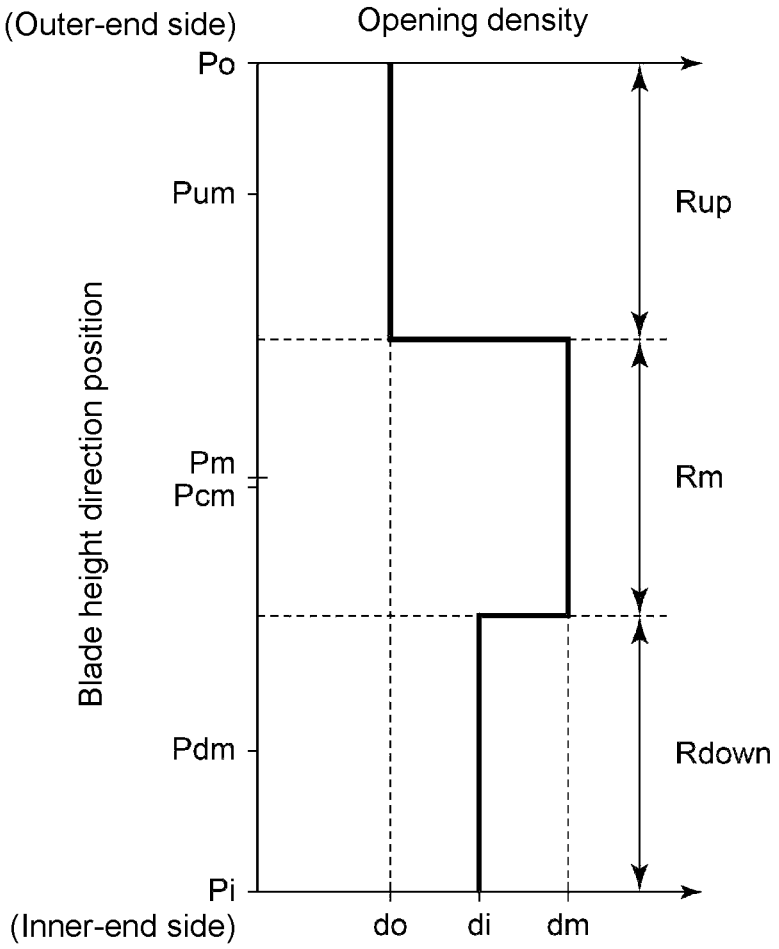
FIG. 12 is a graph showing an example of the opening density distribution of the trailing edge part of the stator vane (turbine blade) according to an embodiment.
Figure 13:
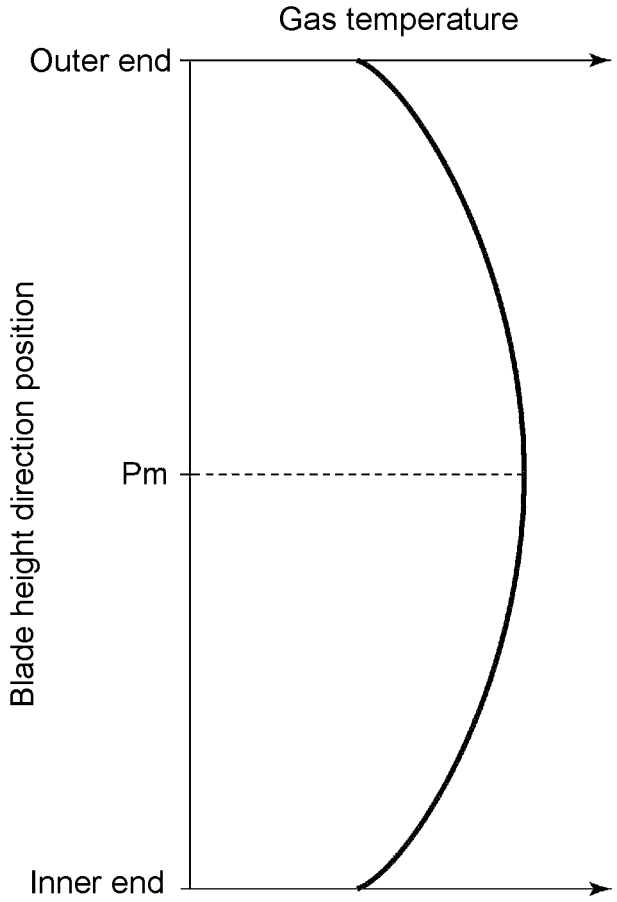
FIG. 13 is a graph showing an example of a temperature distribution of the combustion gas in the blade height direction.
Figure 16:
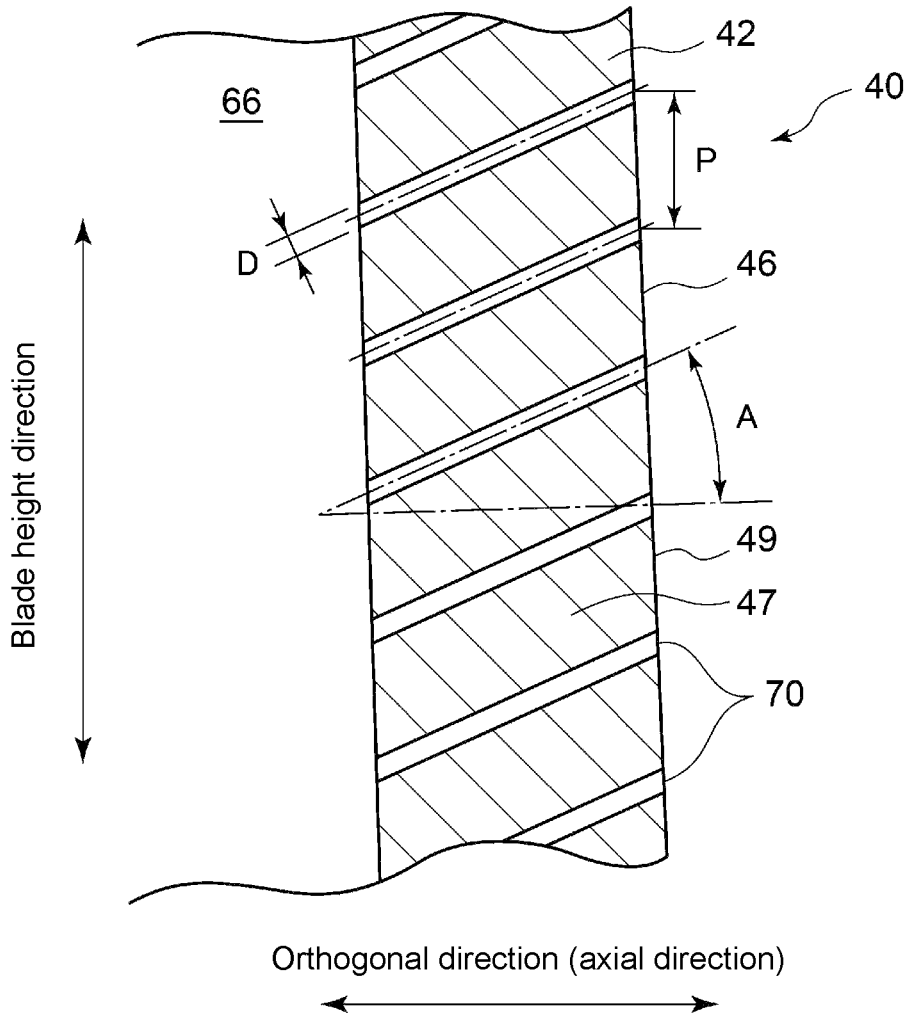
FIG. 16 is a cross-sectional view of the trailing edge part of the turbine blade in the blade height direction according to an embodiment.
Figure 17:
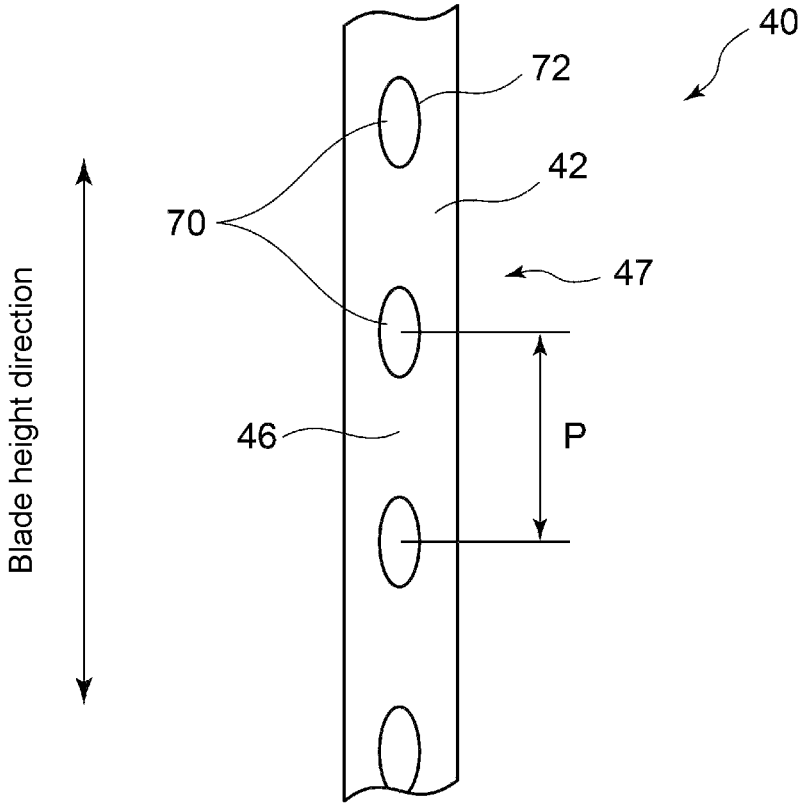
FIG. 17 is a view of the trailing edge part of the turbine blade as seen in a direction from a trailing edge toward a leading edge of an airfoil portion according to an embodiment.

FIGS. 6 to 8, and FIGS. 14 and 15 are graphs each showing an example of the opening density distribution of the trailing edge part 47 of the rotor blade 26 (turbine blade 40) in the blade height direction according to an embodiment. FIGS. 9 and 13 are graphs each showing an example of a temperature distribution of the combustion gas in the blade height direction. FIGS. 10 to 12 are graphs each showing an example of the opening density distribution of the trailing edge part 47 of the stator vane 24 (turbine blade 40) in the blade height direction according to an embodiment. FIG. 16 is a cross-sectional view of the trailing edge part 47 of the turbine blade 40 in the blade height direction according to an embodiment. FIG. 17 is a view of the trailing edge part 47 of the turbine blade 40 as seen in a direction from the trailing edge toward the leading edge of the airfoil portion according to an embodiment.

In the description below, "upstream" and "downstream" respectively refer to "upstream of a flow of a cooling medium in the cooling passage 66" and "upstream of the flow of the cooling medium in the cooling passage 66".

In some embodiments, the relation of d_up<d_mid<d_down is satisfied, where d_mid is an index indicating the opening densities (to be also referred to as an opening density index hereinafter) of the cooling holes 70 in the center region including an intermediate position Pm between the first end and the second end which are the both ends of the airfoil portion 42 in the blade height direction, d_up is the opening density index of the cooling holes 70 in the upstream region positioned upstream from the center region, and d_down is the opening density index of the cooling holes 70 in the downstream region positioned downstream from a center region Rm.

Furthermore, in some embodiments, the above-described opening density index d_mid of the cooling holes 70 in the center region, the above-described opening density index d_up of the cooling holes 70 in the upstream region, and the above-described opening density index d_down of the cooling holes 70 in the downstream region satisfy the relation of d_up<d_down<d_mid.

The present embodiments will respectively be described in the case in which the turbine blade 40 is the rotor blade 26 and in the case in which the turbine blade 40 is the stator vane 24.

First, of the above-described embodiments, some embodiments in which the turbine blade 40 is the rotor blade 26 will be described with reference to FIGS. 4 and 6 to 9.

In the case in which the turbine blade 40 is the rotor blade 26, since the cooling medium flows through the cooling passage 66 (the last path 60*e* of the serpentine flow passage 60) from the side of the root 50 toward the side of the tip 48 (see FIGS. 2 and 4), "upstream" and "downstream" of the flow of the cooling medium in the cooling passage 66 respectively correspond to the side of the root 50 and the side of the tip 48 of the airfoil portion 42 in the cooling passage 66. In addition, the first end and the second end which are the both ends of the airfoil portion 42 in the blade height direction respectively correspond to the tip 48 and the root 50.

Figure 6:
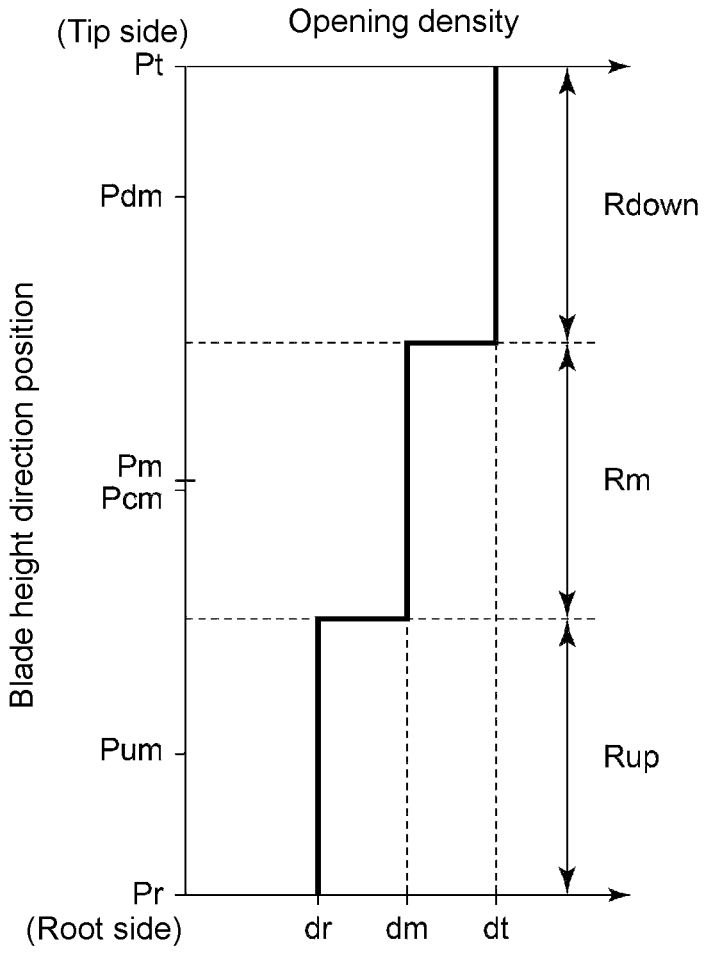
FIG. 6 is a graph showing an example of an opening density distribution of a trailing edge part of the rotor blade (turbine blade) according to an embodiment.
Figure 7:
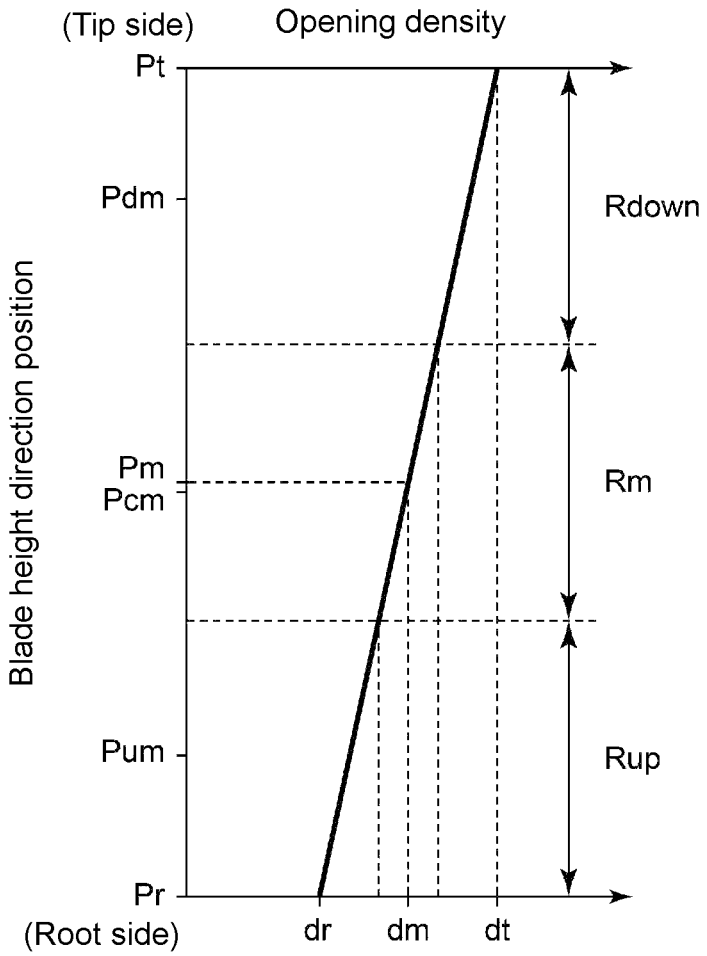
FIG. 7 is a graph showing an example of the opening density distribution of the trailing edge part of the rotor blade (turbine blade) according to an embodiment.

In some embodiments, for example, as indicated by the graphs of FIGS. 6 and 7, the opening density index d_mid of the cooling holes 70 in the center region Rm including the intermediate position Pm between the tip 48 and the root 50 of the airfoil portion 42 in the blade height direction, the opening density index d_up of the cooling holes 70 in an upstream region Rup positioned upstream (the side of the root 50) from the center region Rm, and the opening density index d_down of the cooling holes 70 in a downstream region Rdown positioned downstream (the side of the tip 48) from the center region Rm satisfy the relation of d_up<d_mid<d_down.

In the embodiment according to the graph of FIG. 6, the region in the blade height direction of the airfoil portion 42 is divided into three regions which include the center region Rm, the upstream region Rup including the root 50 and positioned closer to the root 50 than the center region Rm, and the downstream region Rdown including the tip 48 and positioned closer to the tip 48 than the center region Rm. Then, the opening densities of the cooling holes 70 are uniform and constant in each of the three regions, and the opening densities change stepwise in the blade height direction.

That is, the opening density index d_mid of the cooling holes 70 in the center region Rm is set to a constant opening density index dm at the intermediate position Pm, the opening density index d_up of the cooling holes 70 in the upstream region Rup is set to a constant opening density index dr (provided that dr<dm) at a position Pr between the intermediate position Pm and the root 50, and the opening density index d_down of the cooling holes 70 in the downstream region Rdown is set to a constant opening density index dt (provided that dm<dt) at a position Pt between the intermediate position Pm and the tip 48.

In FIG. 6, regarding each of the upstream region Rup, the center region Rm, and the downstream region Rdown, the relation of d_up<d_mid<d_down may be satisfied, provided that all the opening densities of the cooling holes 70 in the respective regions are the same and constant, and the opening density indexes of the cooling holes 70 at radial regional intermediate positions in the respective regions are respectively d_up, d_mid, and d_down. Regional intermediate positions in the respective regions are respectively denoted by Pdm, Pcm, and Pum with respect to the upstream region Rup, the center region Rm, and the downstream region Rdown. Pdm, Pcm, and Pum may each be an intermediate position of a radial length between a position of the cooling hole 70 arranged most radially outward and a position of the cooling hole 70 arranged most radially inward in a corresponding one of the regions. Alternatively, Pdm, Pcm, and Pum may each be a position of the cooling hole arranged at a position corresponding to the intermediate number of cooling holes radially arranged in the corresponding one of the regions. Moreover, the cooling holes 70 may each have a hole diameter D which remains the same from the side of the tip 48 to the side of the root 50, or the cooling holes 70 each having the varying hole diameter D may be combined. Alternatively, regarding each of the upstream region Rup, the center region Rm, and the downstream region Rdown, an average opening density index in the respective regions may satisfy the relation of d_up<d_mid<d_down if the cooling holes 70 having different opening densities are included. The average opening density index in each region means an index indicating an average of all the opening densities of the cooling holes 70 in the each region.

It is desirable to arrange the regional intermediate position Pum of the upstream region Rup at a position which includes a position of a ¼ L length from the root 50 relative to a total length L between the tip 48 and the root 50 in the blade height direction, and is closer to the side of the root 50. It is desirable to arrange the regional intermediate position Pcm of the center region Rm between the position of the ¼ L length and a position of a ¾ L length from the root 50. Moreover, it is desirable to arrange the regional intermediate position Pdm of the downstream region Rdown at a position which includes a position of the ¾ L length from the root 50, and is between the tip 48 and said position.

In the embodiment according to the graph of FIG. 7, in the blade height direction of the airfoil portion 42, the opening densities of the cooling holes 70 continuously change so as to increase from the side of the root 50 toward the side of the tip 48.

That is, the opening density index d_mid of the cooling holes 70 in the center region Rm is a value of a range including the opening density index dm at the intermediate position Pm, the opening density index d_up of the cooling holes 70 in the upstream region Rup is a value not less than the opening density index dr at the position Pr on the side of the root 50 and less than the opening density index dm at the intermediate position Pm, and the opening density index d_down of the cooling holes 70 in the downstream region Rdown is a value not more than the opening density index dt at the position Pt on the side of the tip 48 and more than the opening density index dm at the intermediate position Pm.

Since the cooling medium flows in the cooling passage 66 formed inside the airfoil portion 42 of the rotor blade 26 (turbine blade 40) while cooling the airfoil portion 42, a temperature distribution in which the temperature increases downstream (the side of the tip 48) of the flow of the cooling medium, that is, the aforementioned heatup may occur. In this regard, as the rotor blade 26 (turbine blade 40) according to the above-described embodiment, by making the opening densities of the cooling holes 70 higher at the position downstream (the side of the tip 48) than at the position upstream (the side of the root 50) of the flow of the cooling medium in the cooling passage 66, it is possible to increase the supply flow rate of the cooling medium via the cooling holes 70 downstream (the side of the tip 48) where the temperature of the cooling medium is relatively high. Thus, it is possible to appropriately cool the trailing edge part 47 of the rotor blade 26 (turbine blade 40) in accordance with the temperature distribution of the cooling passage 66.

In addition, it is possible to relatively decrease the opening densities of the cooling holes 70 for the entire airfoil portion 42 by making the opening densities of the cooling holes 70 lower in a partial region in the blade height direction of the airfoil portion 42 than other regions. Thus, the pressure of the cooling passage 66 is easily maintained high, making it possible to appropriately maintain a differential pressure between the cooling passage 66 and the exterior of the turbine blade 40 (for example, the combustion gas flow passage 28 of the gas turbine 1), and to easily and effectively supply the cooling medium to the cooling holes 70.

The opening density distribution of the cooling holes 70 in the blade height direction is not limited to that indicated by the graph of FIG. 6 or 7 as long as the above-described opening density indexes d_mid, d_up, and d_down satisfy the relation of d_up<d_mid<d_down.

For example, a region in the blade height direction of the airfoil portion 42 may be divided into more than three regions, and opening densities of the cooling holes 70 in respective regions may change stepwise so as to gradually increase from the side of the root 50 toward the side of the tip 48.

Alternatively, for example, in the region in the blade height direction of the airfoil portion 42, opening densities of the cooling holes 70 may continuously change in some regions, and opening densities of the cooling holes 70 may be constant in some other regions.

Figure 8:
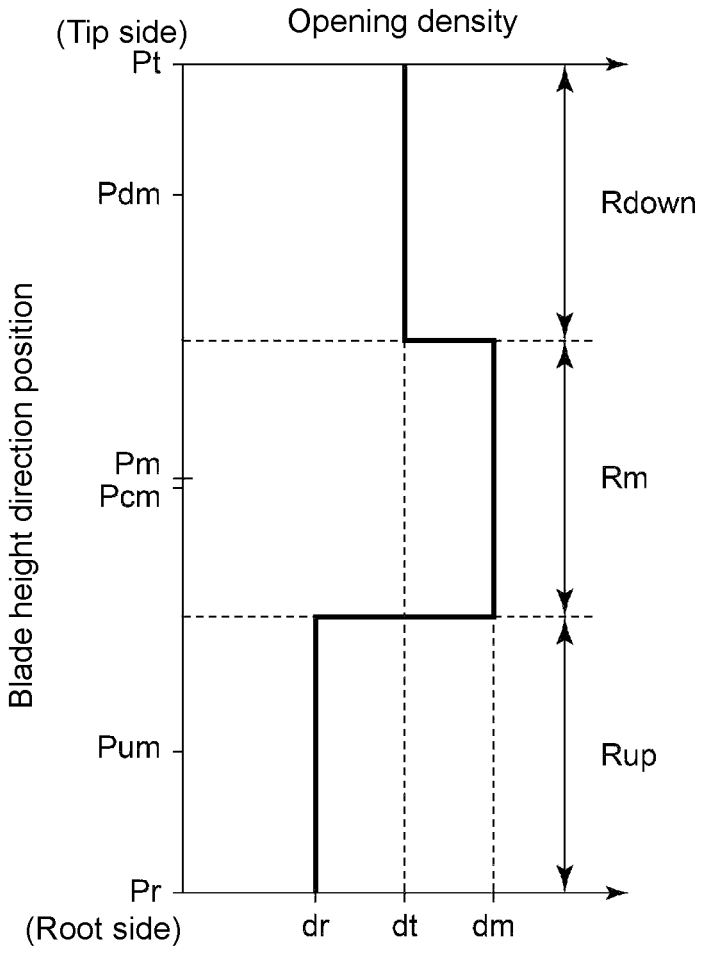
FIG. 8 is a graph showing an example of the opening density distribution of the trailing edge part of the rotor blade (turbine blade) according to an embodiment.

In some embodiments, for example, as indicated by the graph of FIG. 8, the opening density index d_mid of the cooling holes 70 in the center region, the opening density index d_up of the cooling holes 70 in the upstream region positioned upstream (the side of the root 50) from the center region, and the opening density index d_down of the cooling holes 70 in the downstream region positioned downstream (the side of the tip 48) from the center region satisfy the relation of d_up<d_down<d_mid.

In the embodiment according to the graph of FIG. 8, the region in the blade height direction of the airfoil portion 42 is divided into three regions which include the center region Rm, the upstream region Rup including the root 50 and positioned closer to the root 50 than the center region Rm, and the downstream region Rdown including the tip 48 and positioned closer to the tip 48 than the center region Rm. Then, the opening densities of the cooling holes 70 are constant in each of the three regions, and the opening densities change stepwise in the blade height direction.

That is, the opening density index d_mid of the cooling holes 70 in the center region Rm is set to the constant dm at the intermediate position Pm, the opening density index d_up of the cooling holes 70 in the upstream region Rup is set to the constant opening density index dr (provided that dr<dm) at the position Pr between the intermediate position Pm and the root 50, and the opening density index d_down of the cooling holes 70 in the downstream region Rdown is set to the constant opening density index dt (provided that dr<dt<dm) at the position Pt between the intermediate position Pm and the tip 48.

The temperature of the gas flowing through the combustion gas flow passage 28 where the rotor blades 26 (turbine blades 40) are arranged (see FIG. 1) is distributed as indicated by, for example, the graph of FIG. 9, and tends to be higher in the center region including the intermediate position Pm between the tip 48 and the root 50 than in the region on the side of the tip 48 and the region on the side of the root 50 of the airfoil portion 42 in the blade height direction.

On the other hand, since the cooling medium flows in the cooling passage 66 formed inside the airfoil portion 42 while cooling the airfoil portion 42, the temperature distribution may occur in which the temperature increases downstream (the side of the tip 48) of the flow of the cooling medium. In this case, in order to appropriately cool the trailing edge part 47, it is desirable to maximize flow rate of the cooling medium via the cooling holes 70 in the center region Rm in the blade height direction and to make flow rate of the cooling medium via the cooling holes 70 higher in the downstream region Rdown than in the upstream region Rup described above.

That is, as described above, the cooling medium is heated up in the process of flowing in the last path **60*e*, and the metal temperature of the cooling holes 70 at the tip 48 of the last path 60*e* or in the downstream region Rdown becomes the highest. However, in the case of a blade where the metal temperature is kept within a range not exceeding the service temperature limit determined from the oxidation thinning allowance, it is possible to suppress the damage to the blade by selecting the opening density distributions of the cooling holes 70 shown in FIGS. 20C and 6. On the other hand, in the case of a blade which operates in the atmosphere of the combustion gas indicating the combustion gas temperature distribution of FIG. 9, the airfoil portion 42 receives a large heat input from the combustion gas in the center region Rm, and thus, with the opening density indexes of the cooling holes 70 in the center region Rm shown in FIGS. 20C and 6, the metal temperature of the cooling holes 70 in the center region Rm may exceed the service temperature limit. In this case, it is necessary to enhance cooling by further increasing the opening density index of the cooling holes 70 in the center region Rm. That is, the supply flow rate of the cooling medium flowing through the cooling holes 70 in the downstream region Rdown is reduced by decreasing the opening density index of the cooling holes 70 in the downstream region Rdown and increasing the opening density index of the cooling holes 70 in the center region Rm, making it possible to increase the supply flow rate of the cooling medium flowing through the cooling holes 70 in the center region Rm. Depending on the metal temperature, the opening density distribution may be selected, in which the metal temperature of the cooling holes 70 at the tip 48 of the last path 60***e* and in the downstream region Rdown, and the metal temperature in the center region Rm fall within the service temperature limit, by further decreasing the opening density index of the cooling holes 70 in the upstream region Rup. In addition, the opening density distribution of the cooling holes 70 for each region in the present embodiment may be selected by also confirming that the aforementioned creep strengths in the center region Rm and the upstream region Rup fall within the creep limit.

As the rotor blade 26 (turbine blade 40) according to the above-described embodiment, by making the opening density index d_mid of the cooling holes 70 in the center region Rm larger than the opening density indexes d_up, d_down of the cooling holes 70 in the upstream region Rup and the downstream region Rdown described above, it is possible to increase the supply flow rate of the cooling medium via the cooling holes 70 in the center region Rm where the temperature of the gas flowing through the combustion gas flow passage 28 is relatively high. Moreover, as the rotor blade 26 (turbine blade 40) according to the above-described embodiment, by making the opening density index d_down of the cooling holes 70 in the downstream region Rdown larger than the opening density index d_up of the cooling holes 70 in the upstream region Rup, it is possible to increase the supply flow rate of the cooling medium via the cooling holes 70 in the downstream region Rdown where the temperature of the cooling medium is higher than in the upstream region Rup. Thus, it is possible to appropriately cool the trailing edge part 47 of the rotor blade 26 (turbine blade 40) in accordance with the temperature distribution of the cooling passage 66.

In FIG. 8, regarding each of the upstream region Rup, the center region Rm, and the downstream region Rdown, the relation of d_up<d_down<d_mid may be satisfied, provided that all the opening densities of the cooling holes 70 in the respective regions are the same and constant, and the opening density indexes of the cooling holes 70 at the radial regional intermediate positions in the respective regions are respectively d_up, d_mid, and d_down. Alternatively, regarding each of the upstream region Rup, the center region Rm, and the downstream region Rdown, the average opening density index in the respective regions may satisfy the relation of d_up<d_down<d_mid if the cooling holes 70 having the different opening densities are included. The ideas of the regional intermediate positions and the average opening density index in the respective regions are as described above. Moreover, the cooling holes 70 may each have the hole diameter D which remains the same from the side of the tip 48 to the side of the root 50, or the cooling holes 70 each having the varying hole diameter D may be combined.

The opening density distribution of the cooling holes 70 in the blade height direction is not limited to that indicated by the graph of FIG. 8 as long as the above-described opening density indexes d_mid, d_up, and d_down satisfy the relation of d_up<d_down<d_mid.

For example, the region in the blade height direction of the airfoil portion 42 may be divided into more than three regions, and opening densities of the cooling holes 70 in respective regions may change stepwise so as to satisfy the above-described relation.

Alternatively, for example, in the region in the blade height direction of the airfoil portion 42, opening densities of the cooling holes 70 may continuously change in at least some regions. In this case, opening densities of the cooling holes 70 may be constant in some other regions in the blade height direction of the airfoil portion 42.

Next, of the above-described embodiments, some embodiments in which the turbine blade 40 is the stator vane 24 will be described with reference to FIGS. 5 and 10 to 13.

In the case in which the turbine blade 40 is the stator vane 24, since the cooling medium flows through the cooling passage 66 (the last path 60*e* of the serpentine flow passage 60) from the side of the outer end 52 toward the side of the inner end 54 (see FIG. 5), "upstream" and "downstream" of the flow of the cooling medium in the cooling passage 66 respectively correspond to the side of the outer end 52 and the side of the inner end 54 of the airfoil portion 42 in the cooling passage 66. In addition, the first end and the second end which are the both ends of the airfoil portion 42 in the blade height direction respectively correspond to the outer end 52 and the inner end 54.

In some embodiments, for example, as indicated by the graphs of FIGS. 10 and 11, the opening density index d_mid of the cooling holes 70 in the center region including the intermediate position Pm between the outer end 52 and the inner end 54 of the airfoil portion 42 in the blade height direction, the opening density index d_up of the cooling holes 70 in the upstream region positioned upstream (the side of the outer end 52) from the center region, and the opening density index d_down of the cooling holes 70 in the downstream region positioned downstream (the side of the inner end 54) from the center region satisfy the relation of d_up<d_mid<d_down.

In the embodiment according to the graph of FIG. 10, the region in the blade height direction of the airfoil portion 42 is divided into three regions which include the center region Rm, the upstream region Rup including the outer end 52 and positioned closer to the outer end 52 than the center region Rm, and the downstream region Rdown including the inner end 54 and positioned closer to the inner end 54 than the center region Rm. Then, the opening densities of the cooling holes 70 are constant in each of the three regions, and the opening densities change stepwise in the blade height direction.

That is, the opening density index d_mid of the cooling holes 70 in the center region Rm is set to the constant opening density index dm at the intermediate position Pm, the opening density index d_up of the cooling holes 70 in the upstream region Rup is set to a constant opening density index do (provided that do<dm) at a position Po between the intermediate position Pm and the outer end 52, and the opening density index d_down of the cooling holes 70 in the downstream region Rdown is set to a constant opening density index di (provided that dm<di) at a position Pi between the intermediate position Pm and the inner end 54.

In the embodiment according to the graph of FIG. 11, in the blade height direction of the airfoil portion 42, the opening densities of the cooling holes 70 continuously change so as to increase from the side of the outer end 52 toward the side of the inner end 54.

That is, the opening density index d_mid of the cooling holes 70 in the center region Rm is a value of a range including the opening density index dm at the intermediate position Pm, the opening density index d_up of the cooling holes 70 in the upstream region Rup is a value not less than the opening density index do at the position Po on the side of the outer end 52 and less than the opening density index dm at the intermediate position Pm, and the opening density index d_down of the cooling holes 70 in the downstream region Rdown is a value not more than the opening density index di at the position Pi on the side of the inner end 54 and more than the opening density index dm at the intermediate position Pm.

Since the cooling medium flows in the cooling passage 66 formed inside the airfoil portion 42 of the stator vane 24 (turbine blade 40) while cooling the airfoil portion 42, a temperature distribution in which the temperature increases downstream (the side of the inner end 54) of the flow of the cooling medium, that is, the aforementioned heatup may occur. In this regard, as the stator vane 24 (turbine blade 40) according to the above-described embodiment, by making the opening densities of the cooling holes 70 higher at the position downstream (the side of the inner end 54) than at the position upstream (the side of the outer end 52) of flow direction of the cooling medium in the cooling passage 66, it is possible to increase the supply flow rate of the cooling medium via the cooling holes 70 downstream (the side of the inner end 54) where the temperature of the cooling medium is relatively high. Thus, it is possible to appropriately cool the trailing edge part 47 of the stator vane 24 (turbine blade 40) in accordance with the temperature distribution of the cooling passage 66.

In FIG. 10, regarding each of the upstream region Rup, the center region Rm, and the downstream region Rdown, the relation of d_up<d_mid<d_down may be satisfied, provided that all the opening densities of the cooling holes 70 in the respective regions are the same and constant, and the opening density indexes of the cooling holes 70 at radial regional intermediate positions in the respective regions are respectively d_up, d_mid, and d_down. Alternatively, regarding each of the upstream region Rup, the center region Rm, and the downstream region Rdown, an average opening density index in the respective regions may satisfy the relation of d_up<d_mid<d_down if the cooling holes 70 having different opening densities are included. The ideas of the regional intermediate positions and the average opening density index in the respective regions are as described above. Moreover, the cooling holes 70 may each have the hole diameter D which remains the same from the side of the tip 48 to the side of the root 50, or the cooling holes 70 each having the varying hole diameter D may be combined.

The opening density distribution of the cooling holes 70 in the blade height direction is not limited to that indicated by the graph of FIG. 10 or 11 as long as the above-described opening density indexes d_mid, d_up, and d_down satisfy the relation of d_up<d_mid<d_down.

For example, the region in the blade height direction of the airfoil portion 42 may be divided into more than three regions, and opening densities of the cooling holes 70 in respective regions may change stepwise so as to gradually increase from the side of the inner end 54 toward the side of the outer end 52.

Alternatively, for example, in the region in the blade height direction of the airfoil portion 42, opening densities of the cooling holes 70 may continuously change in some regions, and opening densities of the cooling holes 70 may be constant in some other regions.

In some embodiments, for example, as indicated by the graph of FIG. 12, the opening density index d_mid of the cooling holes 70 in the center region, the opening density index d_up of the cooling holes 70 in the upstream region positioned upstream (the side of the outer end 52) from the center region, and the opening density index d_down of the cooling holes 70 in the downstream region positioned downstream (the side of the inner end 54) from the center region satisfy the relation of d_up<d_down<d_mid.

In the embodiment according to the graph of FIG. 12, the region in the blade height direction of the airfoil portion 42 is divided into three regions which include the center region Rm, the upstream region Rup including the outer end 52 and positioned closer to the outer end 52 than the center region Rm, and the downstream region Rdown including the inner end 54 and positioned closer to the inner end 54 than the center region Rm. Then, the opening densities of the cooling holes 70 are constant in each of the three regions, and the opening densities change stepwise in the blade height direction.

That is, the opening density index d_mid of the cooling holes 70 in the center region Rm is set to the constant dm at the intermediate position Pm, the opening density index d_up of the cooling holes 70 in the upstream region Rup is set to the constant opening density index do (provided that do<dm) at the position Po between the intermediate position Pm and the outer end 52, and the opening density index d_down of the cooling holes 70 in the downstream region Rdown is set to the constant opening density index di (provided that do<di<dm) at the position Pi between the intermediate position Pm and the inner end 54.

The temperature of the gas flowing through the combustion gas flow passage 28 where the stator vanes 24 (turbine blades 40) are arranged (see FIG. 1) is distributed as indicated by, for example, the graph of FIG. 13, and tends to be higher in the center region including the intermediate position Pm between the outer end 52 and the inner end 54 than in the region on the side of the outer end 52 and the region on the side of the inner end 54 of the airfoil portion 42 in the blade height direction.

On the other hand, since the cooling medium flows in the cooling passage 66 formed inside the airfoil portion 42 while cooling the airfoil portion 42, the temperature distribution may occur in which the temperature increases downstream (the side of the inner end 54) of the flow of the cooling medium. In this case, in order to appropriately cool the trailing edge part 47, it is desirable to maximize flow rate of the cooling medium via the cooling holes 70 in the center region Rm in the blade height direction and to make flow rate of the cooling medium via the cooling holes 70 higher in the downstream region Rdown than in the upstream region Rup described above.

That is, as described above, the cooling medium is heated up in the process of flowing in the last path **60*e*, and the metal temperature of the cooling holes 70 at the inner end 54 of the last path 60***e* or in the downstream region Rdown becomes the highest. However, in the case of the blade where the metal temperature is kept within the range not exceeding the service temperature limit determined from the oxidation thinning allowance, it is possible to suppress the damage to the blade by selecting the opening density distribution of the cooling holes 70 shown in FIG. 10. On the other hand, in the case of a blade which operates in the atmosphere of the combustion gas indicating the combustion gas temperature distribution of FIG. 13, the airfoil portion 42 receives a large heat input from the combustion gas in the center region Rm, and thus, with the opening density index of the cooling holes 70 in the center region Rm shown in FIG. 10, the metal temperature of the cooling holes 70 in the center region Rm may exceed the service temperature limit. In this case, cooling is enhanced by further increasing the opening density index of the cooling holes 70 in the center region Rm. That is, the supply flow rate of the cooling medium flowing through the cooling holes 70 in the downstream region Rdown is reduced by decreasing the opening density index of the cooling holes 70 in the downstream region Rdown and increasing the opening density index of the cooling holes 70 in the center region Rm, making it possible to increase the supply flow rate of the cooling medium flowing through the cooling holes 70 in the center region Rm. Depending on the metal temperature, the opening density distribution may be selected, in which the metal temperature of the cooling holes 70 at the inner end 54 of the last path 60*e* and in the downstream region Rdown, and the metal temperature in the center region Rm fall within the service temperature limit, by further decreasing the opening density index of the cooling holes 70 in the upstream region Rup.

As the stator vane 24 (turbine blade 40) according to the above-described embodiment, by making the opening density index d_mid of the cooling holes 70 in the center region Rm larger than the opening density indexes d_up, d_down of the cooling holes 70 in the upstream region Rup and the downstream region Rdown described above, it is possible to increase the supply flow rate of the cooling medium via the cooling holes 70 in the center region Rm where the temperature of the gas flowing through the combustion gas flow passage 28 is relatively high. Moreover, as the stator vane 24 (turbine blade 40) according to the above-described embodiment, by making the opening density index d_down of the cooling holes 70 in the downstream region Rdown larger than the opening density index d_up of the cooling holes 70 in the upstream region Rup, it is possible to increase the supply flow rate of the cooling medium via the cooling holes 70 in the downstream region Rdown where the temperature of the cooling medium is higher than in the upstream region Rup. Thus, it is possible to appropriately cool the trailing edge part 47 of the stator vane 24 (turbine blade 40) in accordance with the temperature distribution of the cooling passage 66.

In FIG. 12, regarding each of the upstream region Rup, the center region Rm, and the downstream region Rdown, the relation of d_up<d_down<d_mid may be satisfied, provided that all the opening densities of the cooling holes 70 in the respective regions are the same and constant, and the opening density indexes of the cooling holes 70 at the radial regional intermediate positions in the respective regions are respectively d_up, d_mid, and d_down. Alternatively, regarding each of the upstream region Rup, the center region Rm, and the downstream region Rdown, the average opening density index in the respective regions may satisfy the relation of d_up<d_down<d_mid if the cooling holes 70 having the different opening densities are included. The ideas of the regional intermediate positions and the average opening density index in the respective regions are as described above. Moreover, the cooling holes 70 may each have the hole diameter D which remains the same from the side of the tip 48 to the side of the root 50, or the cooling holes 70 each having the varying hole diameter D may be combined.

The opening density distribution of the cooling holes 70 in the blade height direction is not limited to that indicated by the graph of FIG. 13 as long as the above-described opening density indexes d_mid, d_up, and d_down satisfy the relation of d_up<d_down<d_mid.

For example, the region in the blade height direction of the airfoil portion 42 may be divided into more than three regions, and opening densities of the cooling holes 70 in respective regions may change stepwise so as to satisfy the above-described relation.

Alternatively, for example, in the region in the blade height direction of the airfoil portion 42, opening densities of the cooling holes 70 may continuously change in at least some regions. In this case, opening densities of the cooling holes 70 may be constant in some other regions in the blade height direction of the airfoil portion 42.

Next, some other embodiments will be described with reference to FIGS. 4, 14, and 15. In the present embodiments, the turbine blade 40 is the rotor blade 26 (see FIG. 4).

Figure 14:
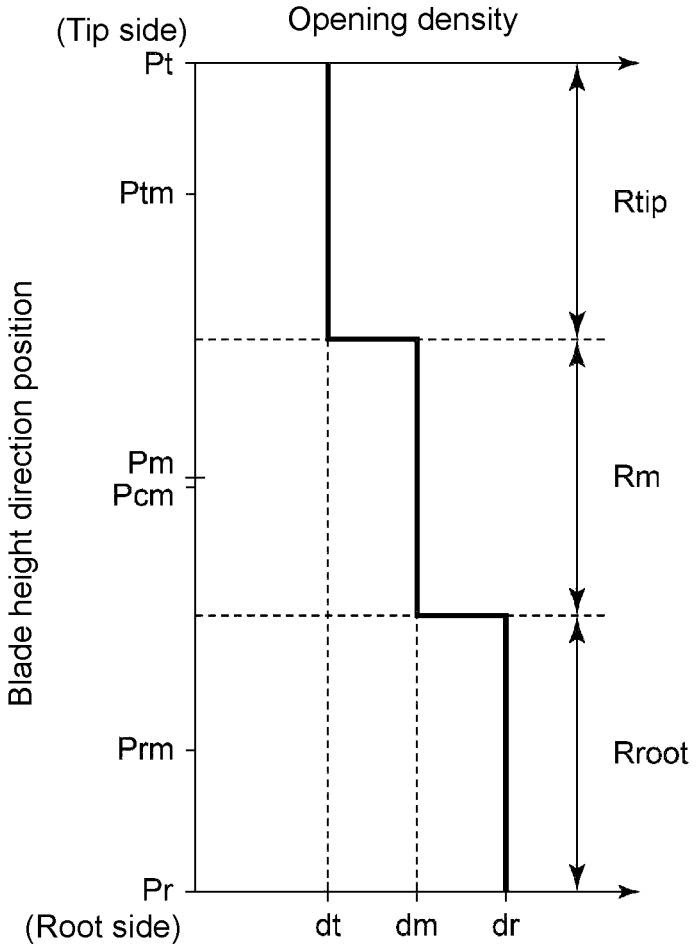
FIG. 14 is a graph showing an example of the opening density distribution of the trailing edge part of the rotor blade (turbine blade) according to an embodiment.

In some embodiments, for example, as indicated by the graph of FIG. 14, the opening density index d_mid of the cooling holes 70 in the center region including the intermediate position Pm between the tip 48 and the root 50 of the airfoil portion 42 in the blade height direction, an opening density index d_tip in the tip region positioned closer to the tip 48 than the center region, and an opening density index d_root in the root region positioned closer to the root 50 than the center region satisfy the relation of d_tip<d_mid<d_root.

In the embodiment according to the graph of FIG. 14, the region in the blade height direction of the airfoil portion 42 is divided into three regions which include the center region Rm, a tip region Rtip including the tip 48 and positioned closer to the tip 48 than the center region Rm, and a root region Rroot including the root 50 and positioned closer to the root 50 than the center region Rm. Then, the opening densities of the cooling holes 70 are constant in each of the three regions, and the opening densities change stepwise in the blade height direction.

That is, the opening density index d_mid of the cooling holes 70 in the center region Rm is set to the constant opening density index dm at the intermediate position Pm, the opening density index d_tip of the cooling holes 70 in the tip region Rtip is set to the constant opening density index dt (provided that dt<dm) at the position Pt between the intermediate position Pm and the tip 48, and the opening density index d_root of the cooling holes 70 in the root region Rroot is set to the constant opening density index dr (provided that dm<dr) at the position Pr between the intermediate position Pm and the root 50.

Since a centrifugal force acts on the cooling medium in the cooling passage 66 formed inside the airfoil portion 42 of the rotor blade 26 upon operation of the gas turbine 1, a pressure distribution may occur in which a pressure increases on the side of the tip 48 of the airfoil portion 42 in the cooling passage 66. In this regard, as the rotor blade 26 (turbine blade 40) according to the above-described embodiment, by making the opening densities of the cooling holes 70 lower at the position on the side of the tip 48 than at the position on the side of the root 50 of the airfoil portion 42, it is possible to decrease a variation in the supply flow rate of the cooling medium via the cooling holes 70 in the blade height direction even if the above-described pressure distribution occurs. Thus, it is possible to appropriately cool the trailing edge part 47 of the rotor blade 26 (turbine blade 40) in accordance with the pressure distribution of the cooling passage 66.

In FIG. 14, regarding each of the root region Rroot, the center region Rm, and the tip region Rtip, the relation of d_tip<d_mid<d_root may be satisfied, provided that all the opening densities of the cooling holes 70 in the respective regions are the same and constant, and the opening density indexes of the cooling holes 70 at radial regional intermediate positions in the respective regions are respectively d_root, d_mid, and d_tip. Regional intermediate positions in the respective regions are respectively denoted by Prm, Pcm, and Ptm with respect to the root region Rroot, the center region Rm, and the tip region Rtip. Alternatively, regarding each of the root region Rroot, the center region Rm, and the tip region Rtip, an average opening density index in the respective regions may satisfy the relation of d_tip<d_mid<d_root if the cooling holes 70 having different opening densities are included. The ideas of the regional intermediate positions and the average opening density index in the respective regions are as described above. Moreover, the cooling holes 70 may each have the hole diameter D which remains the same from the side of the tip 48 to the side of the root 50, or the cooling holes 70 each having the varying hole diameter D may be combined.

The opening density distribution of the cooling holes 70 in the blade height direction is not limited to that indicated by the graph of FIG. 14 as long as the above-described opening density indexes d_mid, d_tip, and d_root satisfy the relation of d_tip<d_mid<d_root.

For example, the region in the blade height direction of the airfoil portion 42 may be divided into more than three regions, and opening densities of the cooling holes 70 in respective regions may change stepwise so as to satisfy the above-described relation.

Alternatively, for example, in the region in the blade height direction of the airfoil portion 42, opening densities of the cooling holes 70 may continuously change in at least some regions. In this case, opening densities of the cooling holes 70 may be constant in some other regions in the blade height direction of the airfoil portion 42.

Figure 15:
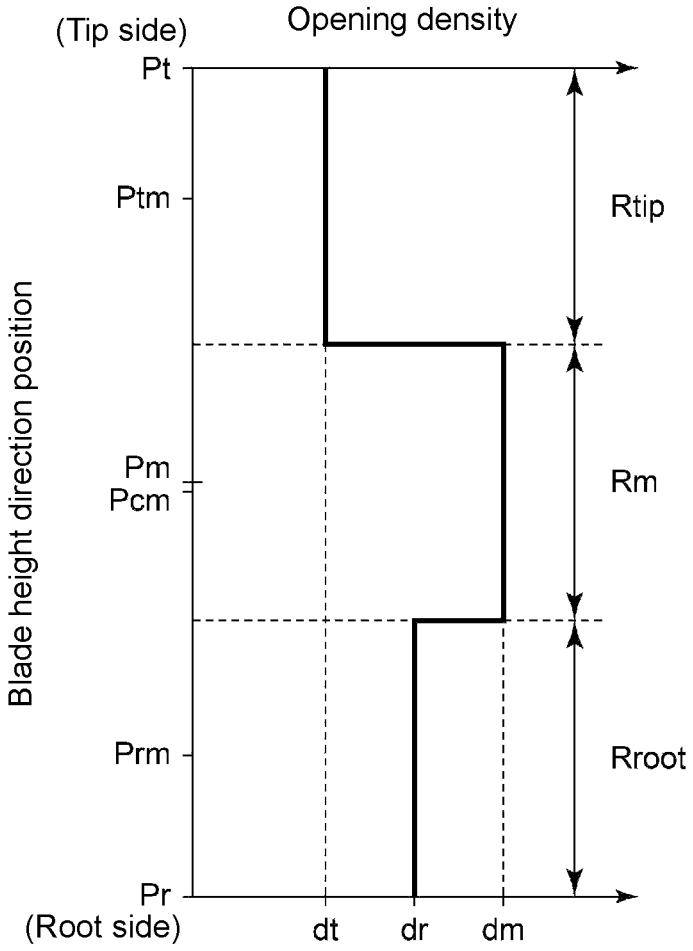
FIG. 15 is a graph showing an example of the opening density distribution of the trailing edge part of the rotor blade (turbine blade) according to an embodiment.

Moreover, in some embodiments, for example, as indicated by the graph of FIG. 15, the opening density index d_mid of the cooling holes 70 in the center region, the opening density index d_tip in the tip region positioned closer to the tip 48 than the center region, and the opening density index d_root in the root region closer to the root 50 than the center region described above satisfy the relation of d_tip<d_root<d_mid.

In the embodiment according to the graph of FIG. 15, the region in the blade height direction of the airfoil portion 42 is divided into three regions which include the center region Rm, the tip region Rtip including the tip 48 and positioned closer to the tip 48 than the center region Rm, and the root region Rroot including the root 50 and positioned closer to the root 50 than the center region Rm. Then, the opening densities of the cooling holes 70 are constant in each of the three regions, and the opening densities change stepwise in the blade height direction.

That is, the opening density index d_mid of the cooling holes 70 in the center region Rm is set to the constant opening density index dm at the intermediate position Pm, the opening density index d_tip of the cooling holes 70 in the tip region Rtip is set to the constant opening density index dt (provided that dt<dm) at the position Pt between the intermediate position Pm and the tip 48, and the opening density index d_root of the cooling holes 70 in the root region Rroot is set to the constant opening density index dr (provided that dt<dr<dm) at the position Pr between the intermediate position Pm and the root 50.

The temperature of the gas flowing through the combustion gas flow passage 28 where the rotor blades 26 (turbine blades 40) are arranged (see FIG. 1) is distributed as indicated by, for example, the graph of FIG. 9, and tends to be higher in the center region including the intermediate position Pm between the tip 48 and the root 50 than in the region on the side of the tip 48 and the region on the side of the root 50 of the airfoil portion 42 in the blade height direction.

On the other hand, since the centrifugal force acts on the cooling medium in the cooling passage 66 formed inside the airfoil portion 42 of the rotor blade 26 upon operation of the gas turbine 1, a pressure distribution may occur in which a pressure increases on the side of the tip 48 of the airfoil portion 42 in the cooling passage 66. In this case, in order to appropriately cool the trailing edge part 47, it is desirable to maximize flow rate of the cooling medium via the cooling holes 70 in the center region in the blade height direction, and to decrease the variation in the supply flow rate of the cooling medium via the cooling holes between the region positioned on the side of the tip 48 and the region positioned on the side of the root 50 in the blade height direction.

In this regard, as the rotor blade 26 (turbine blade 40) according to the above-described embodiment, by making the opening density index d_mid of the cooling holes 70 in the center region Rm larger than the opening density indexes d_tip, d_root of the cooling holes 70 in the tip region Rtip and the root region Rroot described above, it is possible to increase the supply flow rate of the cooling medium via the cooling holes 70 in the center region Rm where the temperature of the gas flowing through the combustion gas flow passage 28 is relatively high. Moreover, as the rotor blade 26 (turbine blade 40) according to the above-described embodiment, by making the opening density index d_tip of the cooling holes 70 in the tip region Rtip smaller than the opening density index d_root of the cooling holes 70 in the root region Rroot, it is possible to decrease the variation in the supply flow rate of the cooling medium via the cooling holes 70 between the tip region Rtip and the root region Rroot even if the above-described pressure distribution occurs. Thus, it is possible to appropriately cool the trailing edge part 47 of the rotor blade 26 (turbine blade 40) in accordance with the pressure distribution of the cooling passage 66.

In FIG. 15, regarding each of the root region Rroot, the center region Rm, and the tip region Rtip, the relation of d_tip<d_root<d_mid may be satisfied, provided that all the opening densities of the cooling holes 70 in the respective regions are the same and constant, and the opening density indexes of the cooling holes 70 at radial regional intermediate positions in the respective regions are respectively d_root, d_mid, and d_tip. The regional intermediate positions in the respective regions are respectively denoted by Prm, Pcm, and Ptm with respect to the root region Rroot, the center region Rm, and the tip region Rtip. Alternatively, regarding each of the root region Rroot, the center region Rm, and the tip region Rtip, the average opening density index in the respective regions may satisfy the relation of d_tip<d_root<d_mid if the cooling holes 70 having the different opening densities are included. The ideas of the regional intermediate positions and the average opening density index in the respective regions are as described above. Moreover, the cooling holes 70 may each have the hole diameter D which remains the same from the side of the tip 48 to the side of the root 50, or the cooling holes 70 each having the varying hole diameter D may be combined.

The opening density distribution of the cooling holes 70 in the blade height direction is not limited to that indicated by the graph of FIG. 15 as long as the above-described opening density indexes d_mid, d_tip, and d_root satisfy the relation of d_tip<d_root<d_mid.

For example, the region in the blade height direction in the airfoil portion 42 may be divided into more than three regions, and opening densities of the cooling holes 70 in respective regions may change stepwise so as to satisfy the above-described relation.

Alternatively, for example, in the region in the blade height direction of the airfoil portion 42, opening densities of the cooling holes 70 may continuously change in at least some regions. In this case, opening densities of the cooling holes 70 may be constant in some other regions in the blade height direction of the airfoil portion 42.

For example, in the embodiments according to the graphs of FIGS. 6, 8, 10, 12, 14, and 15 described above, since the opening densities of the cooling holes 70 in the respective regions (the center region Rm, the upstream region Rup and the downstream region Rdown or the tip region Rtip and the root region Rroot) in the blade height direction of the airfoil portion 42 are respectively constant, the cooling holes are easily processed in the respective regions.

As an opening density index of the cooling holes 70 of the turbine blade 40 described above, for example, a ratio P/D of a pitch P of the cooling holes 70 in the blade height direction (see FIG. 16) and the diameter D of the cooling hole 70 (see FIG. 16) may be adopted. As the diameter D of the cooling hole 70, a maximum diameter, a minimum diameter, or an average diameter of the cooling holes 70 may be used.

Alternatively, as the above-described opening density index, a ratio S/P of a wet-edge length S of an opening end 72 of the cooling hole 70 to the surface of the airfoil portion (see FIG. 17) (that is, a perimeter of the opening end 72 on the surface of the airfoil portion 42) and the pitch P of the cooling holes 70 in the blade height direction (see FIG. 17) may be adopted.

Alternatively, as the above-described opening density index, the number of cooling holes 70 per unit area (or a per unit length) on the surface of the airfoil portion 42 in the trailing edge part 47 of the airfoil portion 42 may be adopted.

The cooling holes 70 formed in the trailing edge part 47 of the airfoil portion 42 of the turbine blade 40 may have the following feature.

In some embodiments, the cooling holes 70 may obliquely be formed with respect to a plane orthogonal to the blade height direction.

By thus obliquely forming the cooling holes 70 with respect to the plane directly running in the blade height direction, it is possible to elongate the cooling holes 70 as compared with a case in which the cooling holes 70 are formed in parallel to the plane orthogonal to the blade height direction. Thus, it is possible to effectively cool the trailing edge part of the turbine blade 40.

In some embodiments, an angle A between an extending direction of the cooling hole 70 and the plane orthogonal to the blade height direction (see FIG. 16) may be not less than 15° and not more than 45° or not less than 20° and not more than 40°. It is possible to form the relatively long cooling holes 70 while maintaining ease of processing of the cooling holes 70 or maintaining the strength of the trailing edge part 47 of the airfoil portion 42, if the angle A falls within the above-described range.

In some embodiments, the cooling holes 70 may be formed in parallel to each other.

By thus forming the plurality of cooling holes 70 in parallel to each other, it is possible to form more cooling holes 70 in the trailing edge part 47 of the airfoil portion 42 than in a case in which the plurality of cooling holes 70 are not in parallel to each other. Thus, it is possible to effectively cool the trailing edge part 47 of the turbine blade 40.

Figure 18:
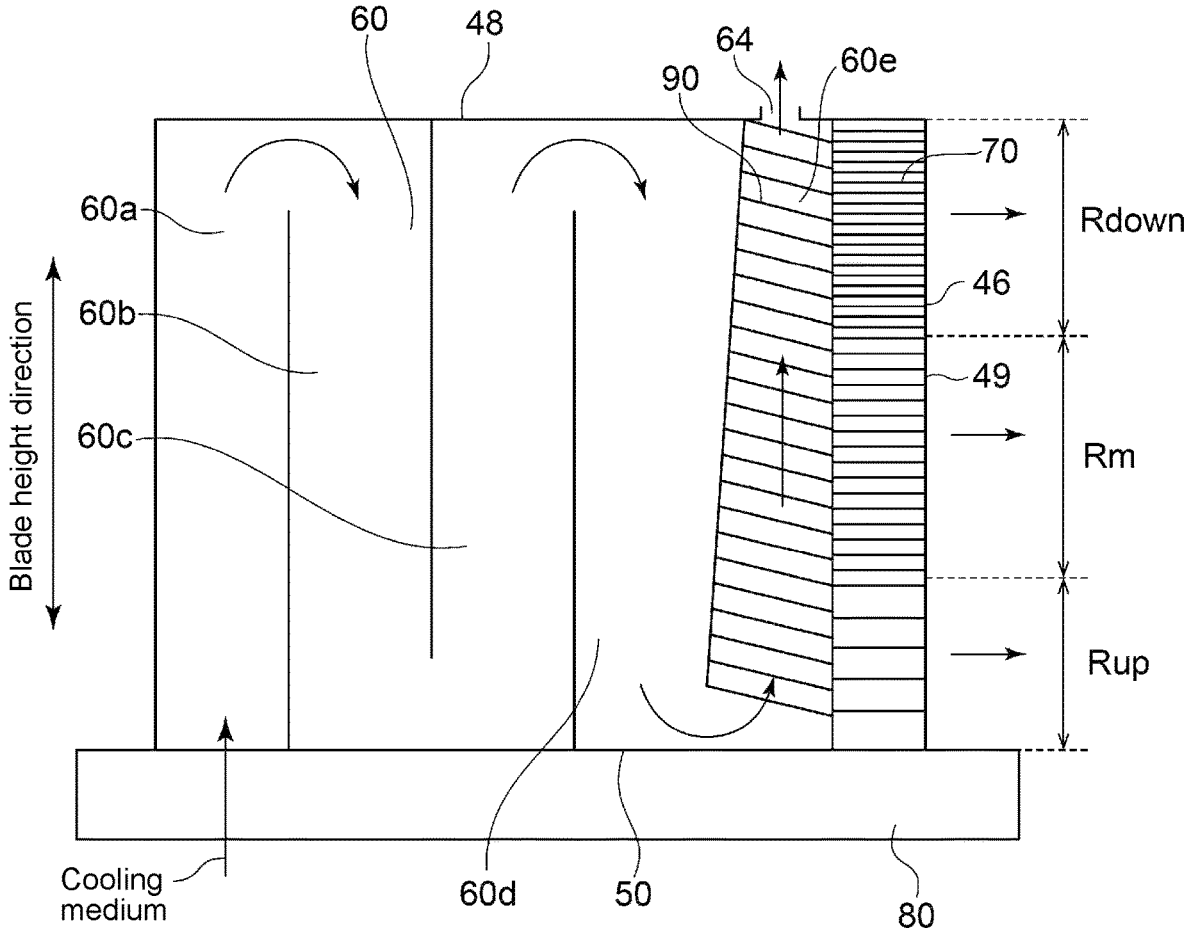
FIG. 18 is a schematic view showing the configuration of a cooling passage of a turbine rotor blade according to an embodiment.

Next, the relationship between the last path 60*e* and the opening densities of the cooling holes 70 in the trailing edge part 47 will be described below. In general, on a blade inner surface of the serpentine flow passage 60, a turbulator 90 is provided in order to promote heat transfer with the cooling medium. FIG. 18 shows the arrangement of the cooling holes 70 formed in the vicinity of the trailing edge part 47 and the configuration of the last path 60*e* of the cooling passage 66 arranged upstream of flow direction of the cooling medium adjacent to the trailing edge part 47. The turbulator 90 serving as a turbulence promoting material is arranged on each of inner wall surfaces 68 of the pressure surface (concave side) 56 and the suction surface (convex side) 58 of the airfoil portion 42 from the root 50 to the tip 48 in the last path 60*e*. Similarly, turbulators (not shown) are also arranged in the serpentine flow passage 60 upstream of flow direction of the cooling medium from the last path 60*e*.

Figure 19:
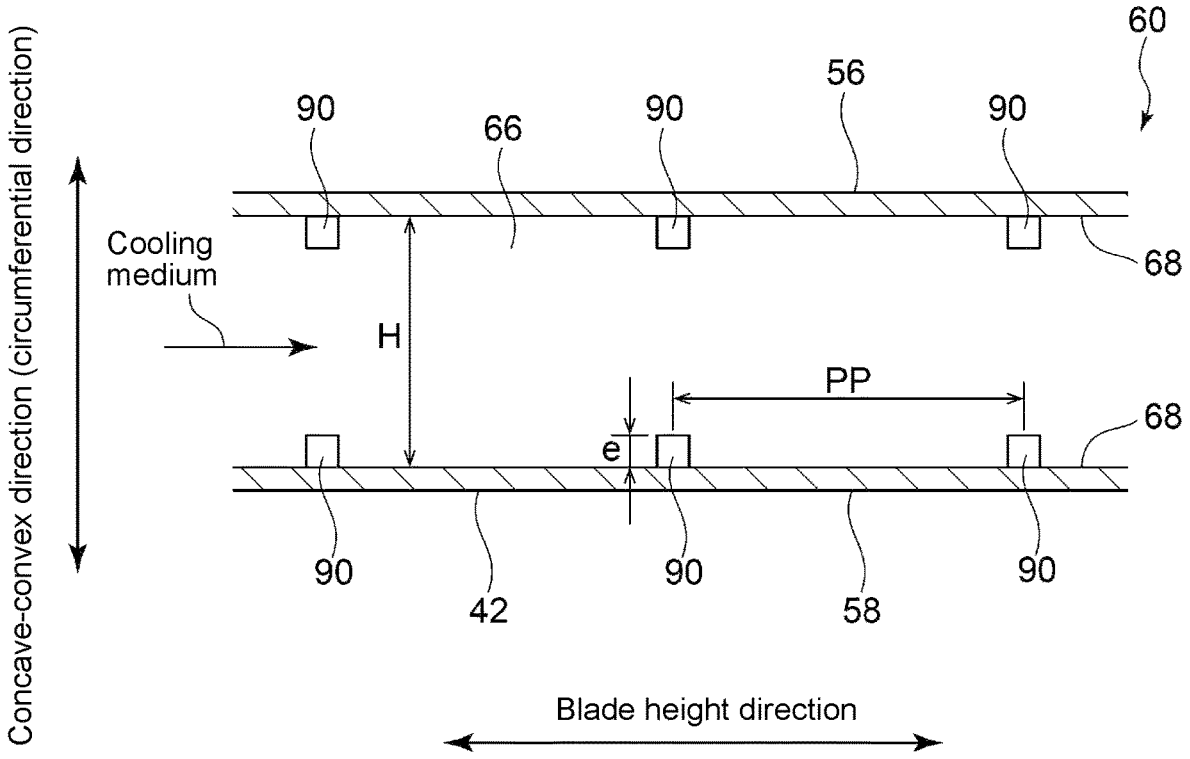
FIG. 19 is a schematic view showing the configuration of a turbulator according to an embodiment.

As shown in FIG. 19, the turbulators 90 arranged in the serpentine flow passage 60 are disposed on the inner wall surfaces 68 of the pressure surface (concave side) 56 and the suction side (convex side) 58 of at least one path of the respective paths 60*a* to 60*e*, and are formed to have a height e with reference to the inner wall surfaces 68 of the turbulators 90. Moreover, each of the paths 60*a* to 60*e* is formed to have a passage width H in a concave-convex direction and for each flow passage, the plurality of turbulators 90 radially arranged adjacent to each other are disposed at the interval of a pitch PP. The turbulators 90 are formed such that a ratio (PP/e) of the pitch PP of the turbulators 90 to the height e, a ratio (e/H) of the height e of the turbulators 90 to the passage width H in the concave-convex direction, and an inclination angle of each of the turbulators 90 with respect to flow direction of the cooling medium are roughly constant from the root 50 to the tip 48, and are arranged so as to obtain optimum heat transfer with the cooling medium.

However, in the last path 60*e*, the passage width H of the last path 60*e* is narrower than those of the other paths 60*a* to 60*d* other than the last path 60*e*. Thus, it may be difficult to select the turbulator height e corresponding to the appropriate ratio (e/H) of the height e of the turbulators 90 to the passage width H of the cooling passage 66 where the aforementioned appropriate heat transfer is obtained. That is, in the case of the last path 60*e*, as compared with the other paths 60*a* to 60*d*, the height e of the turbulators 90 may become too low in order to maintain the appropriate ratio (e/H) of the height e of the turbulators 90 to the passage width H, making it difficult to process the turbulators 90. In particular, since the passage width H is narrower on the side of the tip 48 than on the side of the root 50, it may be difficult to select the appropriate height e of the turbulators 90.

Moreover, the cooling medium flowing into the last path 60*e* of the serpentine flow passage 60 is heated from the inner wall surfaces 68 of the airfoil portion 42 in the process of flowing down the respective paths 60*a* to 60*d* upstream from the last path 60*e* and is supplied to the last path 60*e*. Therefore, the metal temperature of the last path 60*e* is easily increased and is easily increased particularly in the vicinity of the side of the tip 48 of the last path 60*e*. Accordingly, a method of preventing the metal temperature of the last path 60*e* from exceeding the service temperature limit is adopted. For example, a passage structure may be selected in which the passage width H is gradually narrowed from the intermediate position in the blade height direction toward the outlet opening 64 at the tip 48 of the last path 60*e*, a passage cross-sectional area is decreased, and the flow velocity of the cooling medium is increased. It is possible to decrease the passage cross-sectional area of the last path 60*e* toward the outlet opening 64, to increase the flow velocity of the cooling medium, to promote heat transfer with the last path 60*e*, and to suppress the metal temperature of the last path 60*e* to not more than the service limit temperature. If such a structure is applied, the passage width H in the vicinity of the tip 48 of the last path 60*e* tends to decrease.

Thus, the turbulators 90 may be selected, which has the relatively high height e relative to the appropriate height e of the turbulators 90 with respect to the passage width H in a range where a pressure loss of a cooling fluid flowing through the last path 60*e* is allowed. That is, the same constant height e may be selected without changing the height e of the turbulators 90 from the root 50 to the tip 48 although the turbulators 90 formed in the last path 60*e* have the lower height e than the turbulators 90 of the other paths 60*a* to 60*d* other than the last path 60*e*. As a result, the ratio (e/H) of the height e of the turbulators 90 to the passage width H of the last path 60*e* is higher than the ratio (e/H) of the height e to the passage width H applied to each of the other paths 60*a* to 60*d*. By thus selecting the turbulators 90 having the relatively higher height e than an appropriate value in the last path 60*e*, occurrence of turbulence of the cooling medium in the last path 60*e* is promoted, and heat transfer with the cooling medium in the last path 60*e* is further promoted as compared with the other paths 60*a* to 60*d*. As a result, the metal temperature of the last path 60*e* is suppressed to not more than the service temperature limit.

On the other hand, if heat transfer in the last path 60*e* is promoted as described above, the temperature of the cooling medium flowing through the last path 60*e* is further increased while the metal temperature of the last path 60*e* is decreased. The fact that the cooling medium with a temperature increase is supplied to the cooling holes 70 arranged in the trailing edge part 47 may influence the opening density distribution of the trailing edge part 47. That is, cooling of the last path 60*e* is enhanced, and occurrence of a heat stress or the like is improved by decreasing the passage width H in the last path 60*e* toward the side of the tip 48, making the height e of the turbulators 90 in the last path 60*e* relatively higher than that in the other paths 60*a* to 60*d*, or the like. On the other hand, regarding the temperature increase of the cooling medium supplied to the trailing edge part 47, the opening densities of the cooling holes 70 in the trailing edge part 47 from the intermediate position in the blade height direction to the outlet opening 64 at the tip 48 of the last path 60*e* are increased to absorb the temperature increase of the inflow cooling medium and to suppress an increase in the metal temperature of the trailing edge part 47, making it possible to appropriately cool the trailing edge part 47 including the last path 60*e*.

Embodiments of the present invention were described above, but the present invention is not limited thereto, and also includes an embodiment obtained by modifying the above-described embodiment and an embodiment obtained by combining these embodiments as appropriate.

Further, in the present specification, an expression of relative or absolute arrangement such as "in a direction", "along a direction", "parallel", "orthogonal", "centered", "concentric" and "coaxial" shall not be construed as indicating only the arrangement in a strict literal sense, but also includes a state where the arrangement is relatively displaced by a tolerance, or by an angle or a distance whereby it is possible to achieve the same function.

For instance, an expression of an equal state such as "same" "equal" and "uniform" shall not be construed as indicating only the state in which the feature is strictly equal, but also includes a state in which there is a tolerance or a difference that can still achieve the same function.

Further, for instance, an expression of a shape such as a rectangular shape or a cylindrical shape shall not be construed as only the geometrically strict shape, but also includes a shape with unevenness or chamfered corners within the range in which the same effect can be achieved.

As used herein, the expressions "comprising", "containing" or "having" one constitutional element is not an exclusive expression that excludes the presence of other constitutional elements.

REFERENCE SIGNS LIST

1 Gas turbine
2 Compressor
4 Combustor
6 Turbine
8 Rotor
10 Compressor casing
12 Air inlet
16 Stator vane
18 Rotor blade
20 Casing
22 Turbine casing
24 Stator vane
26 Rotor blade
28 Combustion gas flow passage
30 Exhaust chamber
40 Turbine blade
42 Airfoil portion
44 Leading edge
46 Trailing edge
47 Trailing edge part
48 Tip
49 Trailing-edge end surface
50 Root
52 Outer end
54 Inner end
56 pressure surface
58 Suction surface
60 Serpentine flow passage
60*a* to 60*e* Path
60*e* Last path
62 Inlet opening
64 Outlet opening
66 Cooling passage
68 Inner wall surface
70 Cooling hole
72 Opening end
80 Platform
82 Blade root portion
84 Inner flow passage
86 Inner shroud

88 Outer shroud
90 Turbulator
Pm Intermediate position
Pcm Intermediate position of center region
Pum Intermediate position of upstream region
Pdm Intermediate position of downstream region
Ptm Intermediate position of tip region
Prm Intermediate position of root region
Rtip Tip region
Rm Center region
Rroot Root region
Rup Upstream region
Rdown Downstream region

The invention claimed is:

1. A turbine blade comprising:

an airfoil portion;

a cooling passage extending in a blade height direction inside the airfoil portion; and a plurality of cooling holes formed in a trailing edge part of the airfoil portion to be arranged in the blade height direction, the plurality of cooling holes communicating with the cooling passage and opening to a trailing-edge end surface of the airfoil portion in the trailing edge part, the trailing-edge end surface being an end surface facing downstream in an axial direction, wherein a formation region of the plurality of cooling holes in the trailing edge part includes:

a center region including an intermediate position between a first end and a second end of the airfoil portion in the blade height direction, the center region having a constant index d_mid indicating opening densities of the plurality of cooling holes; and an upstream region positioned upstream of a flow of a cooling medium in the cooling passage from the center region in the blade height direction, the upstream region having a constant index d_up indicating the opening densities of the plurality of cooling holes, and wherein a relation of d_up<d_mid is satisfied.

2. A turbine blade comprising:

an airfoil portion;

a cooling passage extending in a blade height direction inside the airfoil portion; and a plurality of cooling holes formed in a trailing edge part of the airfoil portion to be arranged in the blade height direction, the plurality of cooling holes communicating with the cooling passage and opening to a trailing-edge end surface of the airfoil portion in the trailing edge part, the trailing-edge end surface being an end surface facing downstream in an axial direction, wherein the turbine blade is a rotor blade, wherein a formation region of the plurality of cooling holes in the trailing edge part includes:

a center region including an intermediate position between a tip and a root of the airfoil portion in the blade height direction, the center region having a constant index d_mid indicating opening densities of the plurality of cooling holes;

a tip region positioned closer to the tip than the center region in the blade height direction, the tip region having a constant index d_tip indicating the opening densities of the plurality of cooling holes; and a root region positioned closer to the root than the center region in the blade height direction, the root region having a constant index d_root indicating the opening densities of the plurality of cooling holes, wherein a relation of d_tip<d_mid is satisfied, and wherein each of the indexes d_tip, d_root and d_mid indicating the opening densities is represented by a ratio D/P of a through-hole diameter D of each of the cooling holes disposed so as to penetrate the trailing edge part to a pitch P between the cooling holes adjacent to each other in the blade height direction.

3. The turbine blade according to claim 1, wherein the plurality of cooling holes open to the trailing-edge end surface of the airfoil portion, wherein the formation region of the plurality of cooling holes in the trailing edge part includes a downstream region positioned downstream of the flow of the cooling medium from the center region in the blade height direction, the downstream region having a constant index d_down indicating the opening densities of the plurality of cooling holes, and wherein a relation of d_up<d_mid<d_down is satisfied.

4. The turbine blade according to claim 1, wherein the formation region of the plurality of cooling holes in the trailing edge part includes a downstream region positioned downstream of the flow of the cooling medium in the cooling passage from the center region in the blade height direction, the downstream region having a constant index d_down indicating the opening densities of the plurality of cooling holes, and wherein a relation of d_up<d_down<d_mid is satisfied.

5. The turbine blade according to claim 2, wherein a relation of d_tip<d_mid<d_root is satisfied, where d_root is an index in a region positioned closer to the root than the center region in the blade height direction, wherein the index d_root indicating the opening densities is a ratio D/P of a through-hole diameter D of each of the cooling holes disposed so as to penetrate the trailing edge part to a pitch P between the cooling holes adjacent to each other in the blade height direction, and wherein the formation region of the plurality of cooling holes in the trailing edge part includes a root region positioned closer to the root than the center region in the blade height direction and closest to the root in the formation region, the root region having the constant index d_root indicating the opening densities of the plurality of cooling holes.

6. The turbine blade according to claim 2, wherein the plurality of cooling holes are formed in the trailing edge part of the airfoil portion to perform convection-cooling of the trailing edge part, the plurality of cooling holes penetrating the trailing edge part to open to the trailing-edge end surface, and wherein a relation of d_tip<d_root<d_mid is satisfied, where d_root is an index in a region positioned closer to the root than the center region in the blade height direction, and wherein the formation region of the plurality of cooling holes in the trailing edge part includes a root region positioned closer to the root than the center region in the blade height direction and closest to the root in the formation region, the root region having the constant index d_root indicating the opening densities of the plurality of cooling holes.

7. The turbine blade according to claim 1, wherein the center region includes a plurality of cooling holes having the same diameter, and wherein a tip region and a root region each include a plurality of cooling holes having the same diameter as the cooling holes in the center region, the tip region being positioned closer to a tip of the airfoil portion than the center region, the root region being positioned closer to a root of the airfoil portion than the center region.

8. The turbine blade according to claim 2, wherein the center region includes a plurality of cooling holes having the same diameter, and wherein a tip region and a root region each include a plurality of cooling holes having the same diameter as the cooling holes in the center region, the tip region being positioned closer to a tip of the airfoil portion than the center region, the root region being positioned closer to a root of the airfoil portion than the center region.

9. The turbine blade according to claim 1, wherein the plurality of cooling holes are obliquely formed with respect to a plane orthogonal to the blade height direction.

10. The turbine blade according to claim 2, wherein the plurality of cooling holes are obliquely formed with respect to a plane orthogonal to the blade height direction.

11. The turbine blade according to claim 1, wherein the plurality of cooling holes are formed in parallel to each other.

12. The turbine blade according to claim 2, wherein the plurality of cooling holes are formed in parallel to each other.

13. The turbine blade according to claim 1, wherein the cooling passage is a last path of a serpentine flow passage formed inside the airfoil portion.

14. The turbine blade according to claim 2, wherein the cooling passage is a last path of a serpentine flow passage formed inside the airfoil portion.

15. The turbine blade according to claim 1, wherein the turbine blade is a rotor blade, and wherein the cooling passage has an outlet opening formed at a tip of the airfoil portion.

16. The turbine blade according to claim 2, wherein the turbine blade is a rotor blade, and wherein the cooling passage has an outlet opening formed at a tip of the airfoil portion.

17. The turbine blade according to claim 1, wherein the turbine blade is a stator vane, and wherein the cooling passage has an outlet opening formed on an inner shroud of the airfoil portion.

18. A gas turbine comprising:

the turbine blade according to claim 1; and a combustor for producing a combustion gas flowing through a combustion gas flow passage where the turbine blade is disposed.

19. A gas turbine comprising:

the turbine blade according to claim 2; and a combustor for producing a combustion gas flowing through a combustion gas flow passage where the turbine blade is disposed.

* * * * *